US006786032B2

(12) United States Patent
Chia et al.

(10) Patent No.: US 6,786,032 B2
(45) Date of Patent: Sep. 7, 2004

(54) JEWELRY CLOSED-LINK ELEMENT, ASSEMBLED CHAIN, AND METHOD OF MANUFACTURE

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 279 days.

(21) Appl. No.: 09/767,334

(22) Filed: Jan. 23, 2001

(65) Prior Publication Data

US 2002/0189283 A1 Dec. 19, 2002

Related U.S. Application Data

(63) Continuation-in-part of application No. 09/528,820, filed on Mar. 20, 2000, which is a continuation-in-part of application No. 09/337,455, filed on Jun. 21, 1999, which is a continuation-in-part of application No. 09/287,972, filed on Apr. 7, 1999, now Pat. No. 6,209,306.

(51) Int. Cl.[7] ..... B24L 5/02; B24L 17/00
(52) U.S. Cl. ..... 59/35.1; 59/80; 59/82
(58) Field of Search ..... 59/35.1, 80, 82

(56) References Cited

U.S. PATENT DOCUMENTS

| | | | | |
|---|---|---|---|---|
| 848,299 | A | 3/1907 | Feid | |
| 1,055,751 | A | 3/1913 | Hurley | |
| 1,886,784 | A | 11/1932 | Boppenhausen | |
| 4,348,861 | A | 9/1982 | Nakagawa | |
| 4,493,183 | A | 1/1985 | Bucefari et al. | 59/16 |
| 4,651,517 | A | 3/1987 | Benhamou et al. | |
| 4,679,391 | A | 7/1987 | Tizzi | 59/20 |
| 4,934,135 | A | 6/1990 | Rozenwasser | |
| D313,372 | S | 1/1991 | Kulla | |
| D313,771 | S | 1/1991 | Kulla | |
| 4,996,835 | A | 3/1991 | Rozenwasser | |

(List continued on next page.)

FOREIGN PATENT DOCUMENTS

| | | | |
|---|---|---|---|
| DE | 43 24 387 A1 | | 1/1995 |
| EP | D 47D 937 A1 | | 7/1991 |
| FR | 2 446 612 | | 9/1980 |
| GB | 2 279 227 A | | 1/1995 |
| IL | 15948 | | 1/1990 |
| JP | 3-254329 | * | 11/1991 |
| JP | 3-254330 | * | 11/1991 |
| JP | 3-254331 | * | 11/1991 |

OTHER PUBLICATIONS

All Karats International, Edizioni, Primavera–Estate/ *Spring–Summer*, Sixth Edition, Two–tone Diamond Cut Rope Chain; 2 pages (1998).

(List continued on next page.)

*Primary Examiner*—Daivd B. Jones
(74) *Attorney, Agent, or Firm*—Ladas & Parry

(57) ABSTRACT

A closed-link element and a chain made from such link elements are manufacturing by a process, wherein each link element exhibits a unique visual property, such as coloration, surface texture, reflectivity, design feature or characteristic, shape, or other visually attractive appearance. Methods of construction include surface pre-texturing, stamping, simultaneous surface texturing and stamping, and wire bending. Such unique visual property traits for the succession of link elements results in a more attractive, fanciful, more delicate and interesting fashion item. Each of the interconnected link elements may have the same or different visual properties, and may have multiple portions of varying color, texture, or other visual properties. In other aspects of the invention, each link element may have differently shaped portions. Additionally, the interior and/or exterior edges of the link element may exhibit different shapes, colors, patterns, or textures.

67 Claims, 7 Drawing Sheets

U.S. PATENT DOCUMENTS

| | | | | | |
|---|---|---|---|---|---|
| D321,148 | S | | 10/1991 | Chiaramonti et al. | D11/12 |
| D326,065 | S | | 5/1992 | Borgogni | |
| 5,125,225 | A | | 6/1992 | Strobel | |
| 5,129,220 | A | | 7/1992 | Strobel | |
| D329,828 | S | | 9/1992 | Bedoyan | |
| D330,175 | S | | 10/1992 | Kahan | |
| D330,343 | S | | 10/1992 | Bedoyan | |
| 5,185,995 | A | | 2/1993 | Dal Monte | |
| D334,152 | S | | 3/1993 | Rozenwasser | |
| D335,834 | S | | 5/1993 | Grotto | |
| D340,422 | S | | 10/1993 | Grando | |
| D343,136 | S | | 1/1994 | Grando | |
| D343,806 | S | | 2/1994 | Bedoyan | |
| 5,285,625 | A | | 2/1994 | Ofrat et al. | |
| 5,301,498 | A | | 4/1994 | Chia et al. | |
| 5,303,540 | A | | 4/1994 | Rozenwasser | |
| 5,309,704 | A | | 5/1994 | Grando | |
| 5,339,655 | A | | 8/1994 | Grando | |
| 5,353,584 | A | | 10/1994 | Strobel et al. | |
| 5,361,575 | A | | 11/1994 | Rozenwasser | |
| D353,556 | S | | 12/1994 | Chia et al. | |
| 5,408,820 | A | | 4/1995 | Strobel et al. | |
| 5,412,935 | A | | 5/1995 | Rozenwasser | |
| D359,010 | S | | 6/1995 | Rozenwasser | |
| 5,425,228 | A | * | 6/1995 | Hillel | 59/80 |
| 5,437,149 | A | | 8/1995 | Strobel | |
| D362,203 | S | | 9/1995 | Grando | |
| 5,452,572 | A | | 9/1995 | Alvaro et al. | |
| 5,471,830 | A | | 12/1995 | Gonzales | |
| 5,487,264 | A | | 1/1996 | Strobel | |
| D368,048 | S | | 3/1996 | Rozenwasser | |
| D370,184 | S | | 5/1996 | Rozenwasser | |
| D370,426 | S | | 6/1996 | Rozenwasser | |
| 5,526,639 | A | | 6/1996 | Gonzales | |
| 5,531,065 | A | | 7/1996 | Rozenwasser | |
| 5,537,812 | A | | 7/1996 | Rozenwasser | |
| 5,542,244 | A | | 8/1996 | Chia et al. | |
| 5,544,477 | A | * | 8/1996 | Rozenwasser | 59/13 |
| D376,119 | S | | 12/1996 | Rozenwasser | D11/13 |
| 5,581,993 | A | | 12/1996 | Strobel | |
| 5,626,012 | A | | 5/1997 | Fabbro | |
| 5,653,100 | A | | 8/1997 | Dal Monte | |
| 5,660,036 | A | | 8/1997 | Rozenwasser | |
| 5,682,736 | A | | 11/1997 | Chia et al. | |
| 5,775,088 | A | | 7/1998 | Grosz | |
| 5,797,258 | A | | 8/1998 | Strobel et al. | |
| D398,551 | S | | 9/1998 | Kupelian | |
| 5,911,677 | A | | 6/1999 | Kupelian | |
| D424,964 | S | | 5/2000 | Chia et al. | |
| 6,209,306 | B1 | * | 4/2001 | Chia et al. | 59/80 |
| 6,389,790 | B1 | * | 5/2002 | Rosenwasser et al. | 59/80 |
| 6,481,196 | B1 | * | 11/2002 | Chia et al. | 59/80 |
| 6,484,488 | B2 | * | 11/2002 | Rosenwasser et al. | 59/35.1 |

OTHER PUBLICATIONS

Armbrust Chain Company; Providence, Rhode Island; pp. 15, 145, 151, 188 (1975).

Aurora s.r.l.; Vicenza; gold bracelet, necklace, earrings; p. 25 (1997).

Bisarello Pietro S.r.l.; Cavazzale (Vicenza) Italy; untitled page and p. 29 (1971).

Chrysos S.r.l.; (Treviso), Italy; cover page.

Crafford Precision Products Co. Brochure., Crafford Precision Products Co., Riverside, Rhode Island, "The Link–O-Matic" Model 534; 4 pages (1997).

Empress Rope Chain, A.K.S. International; New york; 2 pages.

Fancy Jewelry Imports; Los Angeles, CA; p. 45.

Filk SPA–Catene; via S. Giuseppe; (Vicenza) Italy, *763 VI; p. B 05, B 19 BIS, A 18, B 21.

Istor; Nuruosmaniye Vezirhan Cd. No: 64 Cemberlitas–istabul/Turkey; p. 22.

*JO Magazine*; "Images From our exciting new collection"; 3 pages total.

K Mart, Item #76617103508, Sterling Silver Two–tone Solid Diamond Cut Rope Chain; 3 pages.

Leslie's Jewelry at New York, vol. 698; Item 203–3/2.9/Bi–Color; p. 65.

*L'Oromeccanica Catalog*, L'Oromeccanica SPA; Via Marchesane 115A/36061 Bassano Del Grappa (Vicenza) Italy; cover page, p. 36, 44, 50, one page (1982).

QVC, Item #J64656, 36" Two–tone Solid Rope Necklace, 14K Gold 7.5 grams; 2 pages.

Solid Gold Bracelets, p. 7.

Steven Kretchmer Design; Palenville, NY; 1 page.

Wards D45–9738400, 17" Rope Chain Necklace; #45–9738301, 7" and 18" Roper Chain Bracelet and Necklace; 3 pages.

* cited by examiner

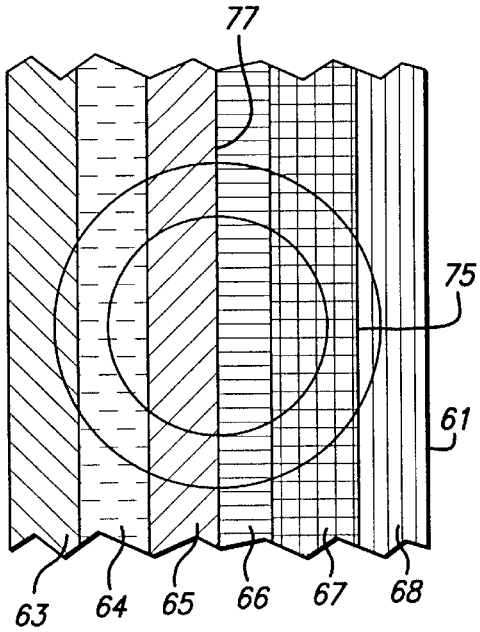
FIG. 8
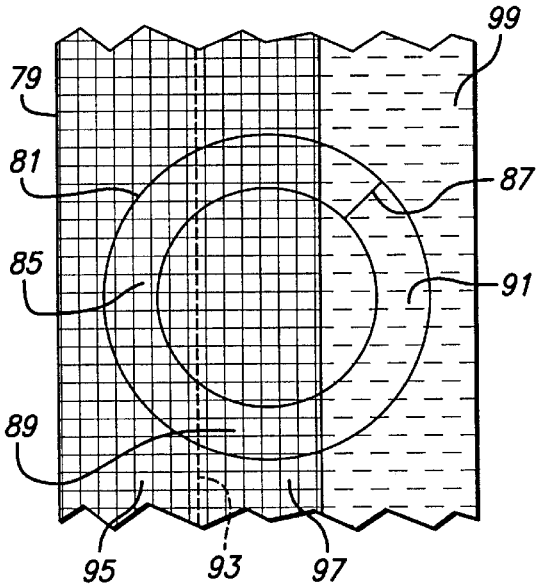
FIG. 9
FIG. 10
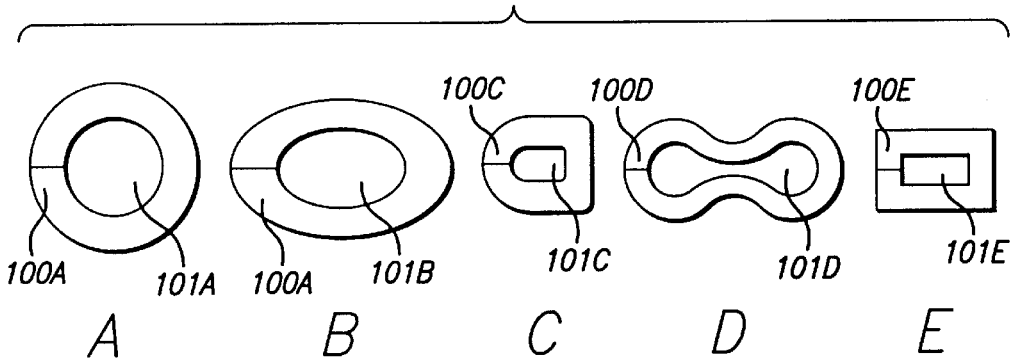
FIG. 11
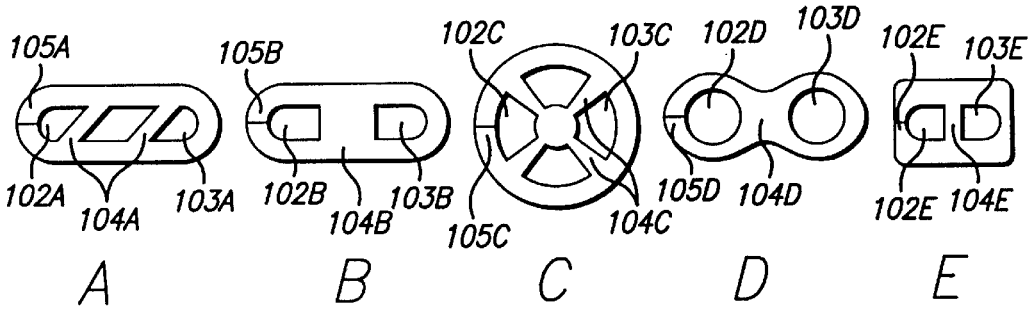

JEWELRY CLOSED-LINK ELEMENT, ASSEMBLED CHAIN, AND METHOD OF MANUFACTURE

CROSS-REFERENCE TO RELATED APPLICATION

This application is a continuation-in-part of application Ser. No. 09/528,820, filed Mar. 20, 2000 and entitled "ORNAMENTAL JEWELRY CHAIN LINK ELEMENT", which is a continuation-in-part of application Ser. No. 09/337,455, filed Jun. 21, 1999 and entitled "JEWELRY CHAIN LINK ELEMENT", which is a continuation-in-part of application Ser. No. 09/287,972, filed Apr. 7, 1999, now U.S. Pat. No. 6,209,306 and entitled "DECORATIVE JEWELRY CHAIN", the entire contents of both applications incorporated herein by reference.

REFERENCE TO DOCUMENT DISCLOSURE CERTIFICATES

Reference is made to U.S. Document Disclosure Certificate Nos.: 449,115 recorded Dec. 22, 1998; 459911 recorded Jul. 30, 1999; 458876 recorded Jul. 5, 1999; 455008 recorded Apr. 19, 1999; and 455009 recorded Apr. 19, 1999; the entire contents of all such certificates incorporated herein by reference.

BACKGROUND OF THE INVENTION

1. Field of the Invention

This invention relates to the field of decorative jewelry items, and more particularly to: the basic structural link element of a jewelry closed-link chain exhibiting attractive, decorative, and ornamental visual properties; a chain of assembled ones of such link elements; and a method of manufacture of the link elements and of the assembled chains.

2. Brief Description of the Prior Art

Jewelry chain link elements, a plurality of which when connected together form a chain, can be manufactured in a variety of ways, including the stamping of link elements from a sheet of appropriate material, most likely a precious metal. In most cases, the material or physical appearance of a link is uniform. In other words, the link may be made from silver, gold, platinum, white gold, brass, or other material. If manufactured of silver, it conventionally would be entirely silver and uniform in its silver appearance. Should the craftsman desire to add a different visual property to the link, it would be added after the manufacture of the link or the completed chain.

Closed-link chains are a popular type of jewelry item made from linking a number of, typically, annular link elements together in a repetitive manner in which each link element has an enclosed open area, and each link element has a linking portion passing through the enclosed open area of an adjacent link element. The result is a chain that is flexible and pleasing to the eye. The annular link elements are typically formed of gold, silver, or other precious metal and may be round in cross section or may be rectangular in cross section with flat major side surfaces, depending on the method of manufacture. The overall generally circular configuration of the annular link elements is completely closed, although there is provided a closed gap to permit the link elements to be twisted open, interlinked with another link element, and then twisted closed again. Preferably, the touching ends of the link element at the closed gap are soldered, sonic welded, or otherwise solidly connected to prevent inadvertent opening of a gap and loss of a link element or the chain itself.

The link elements may be assembled together to form a rather loose interlinked chain, or they may be sized and treated before, during, and/or after assembly, such that tightly interlinked link elements give the chain the appearance of a tire-tread-like pattern, yet the chain remains flexible but to a more limited extent.

A number of link elements may be interconnected in a twisted fashion and in a systematic and repetitive pattern of orientation, resulting in an eye-pleasing, flexible, and beautiful jewelry article that looks and feels like a flattened braided chain.

Some manufacturers of jewelry use different colored gold and silver elements to enhance the beauty of the jewelry article. An example is a closed-link chain in which sets or groups of link elements of one color alternate with sets or groups of link elements of another color, resulting in bracelets or necklaces exhibiting such different colors along their lengths, but with each individual link element being of a single color (and/or texture), assembled with other single colored (and/or textured) link elements. Gold, for example, is available in at least four colors; white, yellow, rose (pink), and green.

Thus, in typical prior art construction techniques for producing closed-link chain jewelry, each link element is of a single solid color, texture, shape, and pattern, e.g., each link element may be stamped from a solid thin sheet of precious metal, such as gold, in the form of an annular ring. While an all yellow gold closed-link chain or an all white gold closed-link chain is attractive, it is otherwise uninteresting due to the monotonic nature of its unvarying coloration, texture, and/or shape along the link elements of the chain. Those prior art closed-link chains that do exhibit variations of colors along their lengths nevertheless are constructed of individual link elements each of which is of a single solid color, texture, shape, and/or pattern.

SUMMARY OF THE INVENTION

The present invention provides the means and methods for constructing closed-link chain link elements in a way to produce a closed-link chain piece of jewelry in which each link element, or selected link elements, and therefore the closed-link chain itself, exhibits unique visual properties.

The present invention teaches the manufacture of a chain link element, whereby the visual property of an individual link element can be varied and determined during the manufacture process. This may be done by stamping the chain link element from a sheet of material and predisposing the desired visual property on or in the sheet of material prior to stamping. For example, a sheet of material may be fabricated with a first visual property and a second visual property. A chain link element is then stamped from the sheet of material forming a chain link element with a first visual property thereon and a second visual property thereon. The visual property may be due to different materials (e.g. gold v. silver), different coloration, different texture, different karat weights, or any other differences in physical or visual appearance. The chain link element thus produced can then be cut (if necessary) or otherwise connected to other chain link elements to form a chain.

A chain link element can be produced from a sheet of material having a variety of different visual properties. The predominant visual property of a chain link element can be varied by varying the visual properties of the sheet of material.

Preferably, the chain link element may be produced with a closed gap during stamping which would preclude the necessity of cutting the chain link element prior to connecting with other chain link elements.

By providing individual link elements with different visual properties, including different shapes, the ultimate appearance of the completed closed-link chain can be determined. For example, if each individual link element exhibits two colors, the resulting closed-link chain will exhibit those two colors in a pattern determined by the manufacturer's designer. Since the link elements overlap, and since they are placed in pre-determined positions when they are interlinked, the location of the colors will have an influence on the appearance of the finished product.

Coloration is only one type of "visual property", and may vary according to the type or formulation of the material or materials from which a link element is made. Reflectivity, surface texture, pattern feature or characteristic, in addition to shape, are among other visual properties of a link that can influence the appearance of a finished closed-link chain. Such unique visual property traits for the succession of link elements results in a more attractive, fanciful, more delicate and interesting fashion jewelry item.

In accordance with one aspect of the present invention, the link elements may be formed by a stamping process whereby the desired visual effects on the link elements are preliminarily provided on or in the sheet of material from which the link elements are later stamped. Alternatively, especially when the visual property is surface texture or shape, the desired visual effects on the link elements may be created during or after the stamping process.

In accordance with another aspect of the invention, the link elements may be manufactured by bending a thin elongated wire of prescribed dimensions into the desired shape. The wire may be supplied on spools and formed by machine. For example, a Link-O-Matic® machine, such as the Model 534 available from Crafford Precision Products Co., One Industrial Court, Riverside, R.I. 02915, can feed, cut, and form a gapped, or non-gapped, link element each cycle of operation. The wire may be manufactured by merging and bonding together two or more thinner wires. Additionally, or alternatively, a wire may undergo a preliminary surface coloring and/or texturing process, such as blackening, oxidizing, plating, serrating, sandblasting, scoring, etc., prior to being cut and formed into a link element by the machine. Or, the machine can form the link element and a subsequent surface texturing and/or coloration process may be employed.

The sheet of material from which link elements are stamped may be fabricated from one or more species of the same substance (e.g., gold of different colors, or gold of different karat weights) or from a combination of substances (e.g., gold and silver). A first portion of the sheet may have a first visual property, and a second portion of the sheet may have a second visual property. Again, each individual region exhibiting a different visual property may be the result of coloration, reflectivity, surface texture, pattern feature or characteristic, shape, or other visual property attribute that provides one portion of the resulting link with a different appearance than another portion of the link.

Importantly, as will be described in detail hereinafter, in the stamping process, in addition to die-cutting the outline for the link element from the sheet of material provided, the die tools or devices may be fabricated to impress a surface texture or shape on one or both major surfaces or on any side edge surface of the link element being die-cut. That is, any surface or surface portion of the stamped link element may exhibit a desired surface texture or shape produced by an impression on, in, or to that surface by the tooling or device employed by the stamping process, effectively imprinting a desired shape, form, or finish.

Portions of a link element may also be shaped by the die-cutting action of the stamping machine.

As indicated, surface texturing may precede or follow the stamping process. However, simultaneous die-cutting and surface texturing is more efficient and is preferred.

After a link element is die-cut from the sheet of material, a subsequent pressure stamping process may be employed to impress designs or patterns on the major or on the side edges of the link element.

By interconnecting together a plurality of link elements made in accordance with the invention, a closed-link chain can be manufactured that exhibits visual properties in a distinctive and decorative pattern. Intermixing link elements exhibiting different visual properties in a particular sequence during assembly of the closed-link chain can likewise produce visually pleasing lengths of closed-link chain.

In the process of altering the physical shape of the individual link elements, simultaneously with the enhancement of the visual effect due to the texturing and/or shape altering techniques, small amounts of the precious metal making up the link elements are removed without reducing the effective dimensional characteristics of the elements and, therefore, without diminishing the structural integrity of the finished closed-link chain product.

Several examples of impressing lines (simulating scoring), serrations, depressions, and other patterns or designs are described in this specification. It should be appreciated that when impressions are made in a soft material, such as gold, during a pressure stamping process, there exists a physical displacement of the material previously occupying the depressed area. Thus, whatever material is pushed out of the depressed area moves to the adjacent regions, thereby making the thickness of the link element greater at such adjacent regions. This is significant, since a thinner sheet of material, at less cost, can be provided. For example, when creating a serrated major surface on a link element being pressure stamped, material pushed out of each groove of the serration pattern necessarily moves into the space between the grooves, increasing the actual maximum thickness of the sheet of material. Again, the combination of enhanced beauty and lower material cost is realized.

Although not intended to be limiting, variations of the present invention, shown and described herein, are distinguished by a changing or varying cross section for portions of the link elements while maintaining at least a portion of at least some of the link elements at a fixed cross section size. Thus, by constructing a chain with link elements having large and small cross sectional portions, a distinct and decorative closed-link chain of a given length may have the identical overall effective chain diameter as one made with all link elements of a constant large cross sectional area, and yet result in substantial manufacturing cost savings due to less material being used in the manufacture of each individual link element.

It can therefore be appreciated that fabricating link elements having variably changing visual properties and/or variably changing cross sections, to provide uniquely shaped building blocks for producing exciting and beautiful visual effects in the construction of closed-link chains, may simultaneously have the synergistic effect of making such physically altered link elements, and thus the closed-link chains from which they are made, less expensive.

In accordance with one aspect of the invention, there is provided a link element, and a method of manufacturing such link element, of the type that is assembled with other link elements to form a closed-link chain in which each of the link elements has an enclosed open area therein through which a linking portion of an adjacent link element may pass. The method includes providing a sheet of material having a plurality of regions adjacent ones of which exhibit different visual properties, and stamping, with a stamping device, a link element from the sheet, forming at least one enclosed open area in the link element for receiving a linking portion of an adjacent link element in a subsequent assembly operation, the link element so produced comprising segments of at least two of the plurality of regions.

In another aspect of the invention, the method includes, during the stamping operation, forming a cut across a portion of the link element, the cut extending from an outside edge of the link element to one of the at least one enclosed open areas, the cut link element portion defining a linking portion adaptable to pass through an enclosed open area of an adjacent link element in a subsequent assembly operation.

In yet another aspect of the invention, there is provided a method of manufacturing a link element of the type that are assembled to form a closed-link chain, the method comprising: providing a sheet of material having a plurality of regions, adjacent ones of which exhibit different visual properties; stamping, with a stamping device, an elongated strip, or slice, of the material, the strip having a prescribed length, width, thickness, and cross sectional configuration; and forming the strip into a closed-link chain link element having a generally O-shaped configuration, a first major surface, an opposite second major surface, an enclosed open area, and an exterior edge, the link element so produced comprising portions of the sheet of material that exhibit at least two of the visual properties.

Instead of, or in addition to, differently textured and/or colored major surfaces, the two major surfaces themselves may exhibit differently textured or colored portions, e.g., one portion of a major surface of a link element may be shiny and yellow gold in color, while another portion may have a sandblasted, frosted, patterned, matte, or simulated diamond cut finish appearance and white gold in color. Also, either major surface may be of a uniform shape and/or texture, while the other major surface is colored and/or textured as described.

A further variation has a portion of the link at a reduced annular width, which reduces material but nonetheless gives the appearance of a closed-link chain having an effective diameter the same as if the reduced portion was of normal annular width.

The interconnecting link elements may have differently colored, patterned, and/or textured portions, and may have different irregular or patterned shapes or shaped portions. For example, some or all of the link elements making up the closed-link chain may be partially or wholly smoothly circular with patterned major surfaces, circular with peripheral undulations, circular with peripheral gear-like teeth, circular with gouges or notches, may have constantly varying cross sectional portions, and/or may have an overall configuration that is star shaped, baguette shaped, square shaped, rectangular shaped, oval shaped, diamond shaped, D-shaped, heart shaped, etc. Similarly, different portions of each link element may have such different physical shapes.

A jewelry closed-link chain link element constructed in accordance with the invention preferably, but not necessarily, may have the shape and configuration of a standard annular link element with at least a portion removed and has a maximum link width equal to that of a similar standard annular link element without any portion removed.

As a result of the various combinations possible in the manufacture of jewelry closed-link chains in accordance with the present invention, a virtually limitless number of different design possibilities exist, and preferred ones of such possibilities are shown and described herein. It is to be understood, however, that all combinations of: the number of interconnected link elements in the repeated pattern along the closed-link chain; solid or portioned coloration and/or texturing; different designs of the portioned regions of each major surface and/or side peripheral edges of the link elements; and different physical shape and/or visual properties as identified in this description may be employed in the manufacture of jewelry closed-link chains and are contemplated variations of the preferred embodiments specifically shown and described.

BRIEF DESCRIPTION OF THE DRAWING

Further objects and advantages and a better understanding of the present invention may be had by reference to the following detailed description taken in conjunction with the accompanying drawings in which certain figures are lined for color or texture, and in which:

FIG. 8 is a plan view of a partial sheet of material and stamped link element similar to that of FIG. 7, but with a different number of colored/textured strips and different widths of the colored/textured strips making up the sheet of material;

FIG. 9 is a view similar to that of FIG. 8, but showing a different orientation of the link element to be stamped from a sheet of material having, selectively, two or three differently colored/textured strips;

FIGS. 10A through 10E are plan views of single-opening closed-link elements showing only representative examples of a limitless number of overall geometrical configuration possibilities;

FIGS. 11A through 11E are plan views of multiple-opening closed-link elements each of which comprises a differently configured dividing member;

DEFINITIONS

Figure 1:
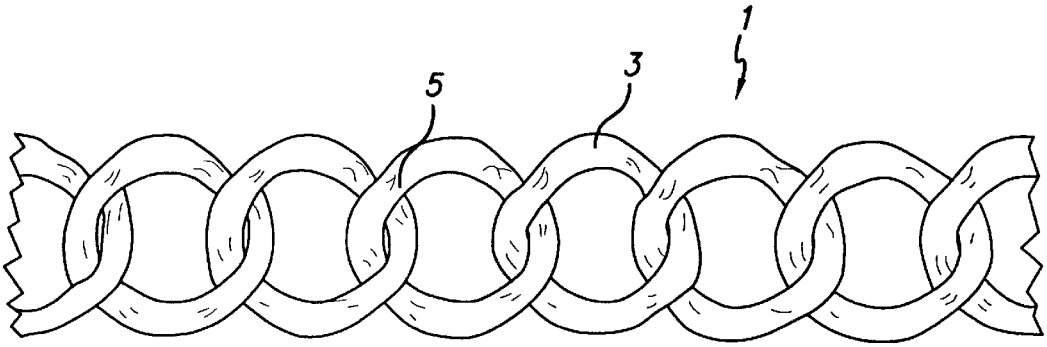
FIG. 1 PRIOR ART
FIG. 1 is a view of the outward appearance of a length of jewelry closed-link chain of the prior art showing a uniform visual appearance for all link elements in the chain for the entire length thereof.

For the purposes of this description, the following definitions are provided.

"Closed-link chain" is a length of interlinked, or interconnected, closed gap link elements, in which each link element has an enclosed open area, and each link element has a linking portion passing through the enclosed open area of an adjacent link element.

A "set" is the number of adjacent interlinked, or interconnected, closed gap link elements making up a structurally repeated pattern along the chain.

A "group" is a number of adjacent interlinked, or interconnected, link elements exhibiting identical visual properties. The number of link elements in a group may be the same or different than the number of link elements in a set. A group, for example may be two or more adjacent "sets". Groups may be uniformly or randomly distributed along the closed-link chain.

A "link", or "link element", is a basic chain building element, a number of which are assembled in series to form a closed-link chain. A closed-link chain is typically comprised of two types of links, a completely closed, or "no-gap", link, and a "closed gap link", the latter having a cut extending from the periphery of the link to an inner enclosed open area, the cut portion defining a "linking portion" adapted to pass through an enclosed open area of an adjacent link element. By bending the two link ends facing at the closed gap, an opening is created through which one or more no-gap links may pass. The bent ends are then brought back together, and the closed gap is filled with solder employing known techniques. It should be understood that the use herein of the term "closed gap" includes a cut link portion in which the facing ends are, in fact, touching, as well as a fully open gap. The width of the gap is to be kept as small as is practical, and small enough that solder will bridge the gap using a powder soldering technique.

In accordance with the present invention, a link may have a circular, baguette, marquis, oval, diamond, rectangular, square, triangular, polygonal, heart, or other geometrical shape. The inner periphery of any "enclosed open area" will be referred to herein as an "interior edge", and the outer periphery will be referred to as an "exterior edge". While the link elements of a closed-link chain are not necessarily annular, it is a popular configuration for the basic building element of a closed-link chain, and for that reason an annular link element will be used in most of the examples shown and described herein without intending to limit the scope of the invention in any way.

The "extent" of a closed-link element, as used herein is the span of the link element from one side of the closed gap, along the body of the link element, and back to the other side of the closed gap.

The "interior" and "exterior" edges of a link element may have raised or depressed patterns therein, or may be notched, gouged, textured, or otherwise physically altered by the stamping process to present a desired pleasing visual effect to the observer.

"Enclosed open area" is defined as any opening in a link element extending from one major surface to the opposite major surface, whether or not such "enclosed open area" is formed in the vicinity of a closed gap.

A "closed gap", as used herein, may or may not be a gap at all. It may be the very small open space, if any, between facing portions of a link which has been formed by a cut made through the link during, or subsequent to, stamping a link, or it may be the very small space between facing ends of a wire or slice of material brought together by a bending operation. A "closed gap" also includes both slightly spaced apart and touching facing portions or ends. For ease of assembly, the size of the open space at the "closed gap" should be small enough that the linking portion of an adjacent link element cannot pass through.

A "visual property", as used herein, is a characteristic of an object which presents a particular visual image to the eye. Such characteristics include, but are not limited to, color, texture, pattern, reflectivity, design, and/or shape. Although shape is also a physical property of an object, in the art of jewelry making, it is often the physical shapes which impart beauty and delicateness to a fashion item.

"Color", as used herein, refers to the quality of the link element or portion thereof with respect to light reflected by it and visually perceived by the eye as a particular hue, saturation, and brightness of the reflected light. In most cases, the different colors exhibited by a link element or portion(s) thereof result from the use of different materials (white gold as differing from yellow gold as differing from rhodium as differing from enamel coatings of different hues, etc.

The "major surface" of a link element refers to the substantially flat or planar upper and lower facial surfaces of a link element. Such surface, although being substantially planar, nevertheless may have raised or depressed patterns therein, or may be notched, gouged, textured, or otherwise physically altered during manufacture to present a desired pleasing visual effect to the observer. Additionally, the upper and lower facial surfaces need not be flat. For example, the link elements may be solid or tubular and have a cross section of any geometric configuration, such as circular or oval in cross section, and yet have the uppermost and lowermost surface portions lying in respective parallel planes.

"Link thickness" is defined as a distance between and perpendicular to the planes of the upper and lower major surfaces of a link element.

"Configuration" refers to the overall shape of a link element as viewed a distance from a "major surface". Typical link elements are O-shaped (annular) or oval, at least prior to being assembled and/or undergoing post assembly shaping of an assembled chain.

"Die-cutting" as used herein refers to the process and tooling with which a die, constructed of hardened metal with sharp edges, is brought into contact with a sheet of material, cutting portions out of the sheet of material according to a predetermined pattern of the sharp edges on the die.

"Stamping", can have the same meaning as "die-cutting" when meaning that a pattern is stamped (cut) out of a sheet of material. However, "stamping" is also defined as imprinting, striking, pounding, marking, or otherwise providing a distinctive character to a surface by the pressure of a die pattern against such surface. Thus, "stamping" can mean cutting of and/or impressing on a sheet of material or an individual link element. In particular, "pressure stamping" impresses a material under pressure, but does not cut through the material.

DETAILED DESCRIPTION OF THE PREFERRED EMBODIMENTS

Conventional closed-link chains, such as chain 1 shown in FIG. 1, are made with a repetitive interlinking of basic link elements 3 which are assembled loosely and then subjected to a post-assembly compression process to flatten out the interlinked region 5. An overall flattened and twisted appearance is the result.

Figure 2:
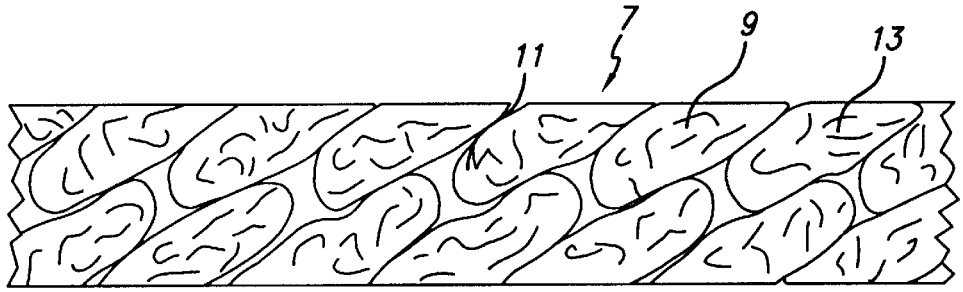
FIG. 2 PRIOR ART
FIG. 2 is a view of the outward appearance of another style of jewelry closed-link chain of the prior art showing a uniform visual appearance for all link elements in the chain for the entire length thereof.

As seen in FIGS. 2, the apparent side-by-side arrangement of small elongated flat segments of chain 7 is the result of assembling and compress-processing closed links having a larger width-to-diameter ratio of the basic link elements 9 than that shown in FIG. 1. Consequently, there is a much smaller space between adjacent flattened sides of link elements 9, giving the illusion that a pair of thick long segments are aligned in parallel but offset from one another at the pressed region 11 where both of a pair of link elements are compressed. This figure shows the possibility of providing a texture 13 to the finished chain, likely done during the pressing procedure, i.e., after the link elements are formed and assembled.

In each of the prior art chains shown in FIGS. 1 and 2, there is no visual difference between one chain portion and another, since each closed-link chain is comprised of a continuous grouping of link elements 1 or 9, all having exactly the same visual property. That is, each link element 1 or 9 is the same color, texture, and shape as all the others in the chain.

Figure 3:
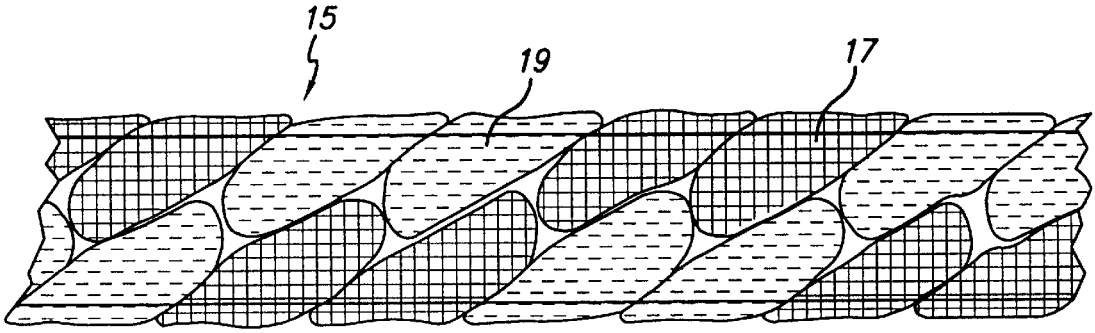
FIG. 3 PRIOR ART
FIG. 3 is a view of the outward appearance of another style of jewelry closed-link chain of the prior art showing two different colored link elements forming the chain, each individual link element having a uniform visual appearance.

FIG. 3 also shows a tight assembly of closed links forming a closed-link chain 15. A tighter positioning of the link segments would be possible, leaving virtually no open spaces, if a chain is either constructed of link elements having a very high width-to-diameter ratio of the basic link elements 17, 19, or a greater post-assembly pressure is applied when the chain is subjected to a compression force flattening the link elements and forcing flow of precious metal laterally in the process.

It will be observed in FIG. 3 that different portions of the chain have a different color than other portions. However, each link element that makes up the chain is either a solid yellow gold link 17 or a solid white gold link 19.

Figure 4:
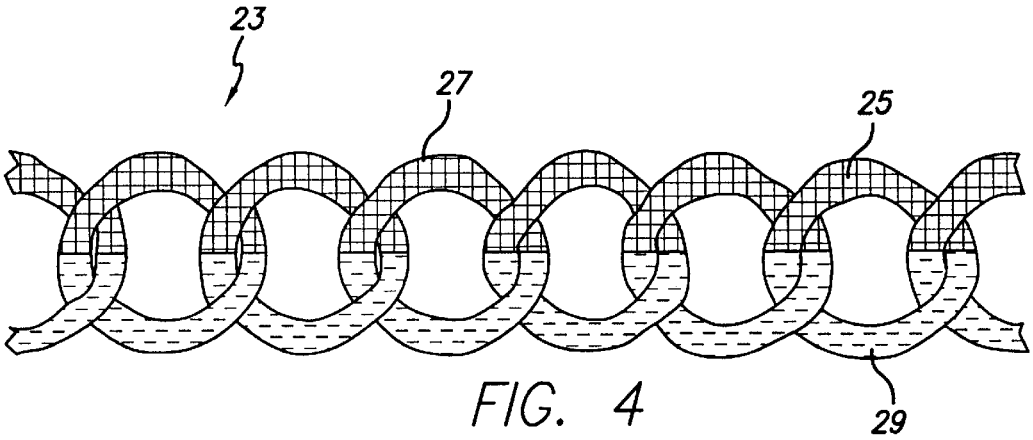
FIG. 4 is a view of the outward appearance of a length of jewelry closed-link chain in accordance with the present invention, similar in construction to that of FIG. 1, but with each link element comprising two differently colored or textured regions.

FIG. 4 is a view of a simple closed-link chain 23, manufactured in accordance with the principles of the present invention, similar to that shown in FIG. 1 but with each link element 25 exhibiting two different colors in the respective two different halves 27 and 29. The link half 27 is lined for the color yellow gold, and the link half 29 is lined for white gold or silver.

Figure 5:
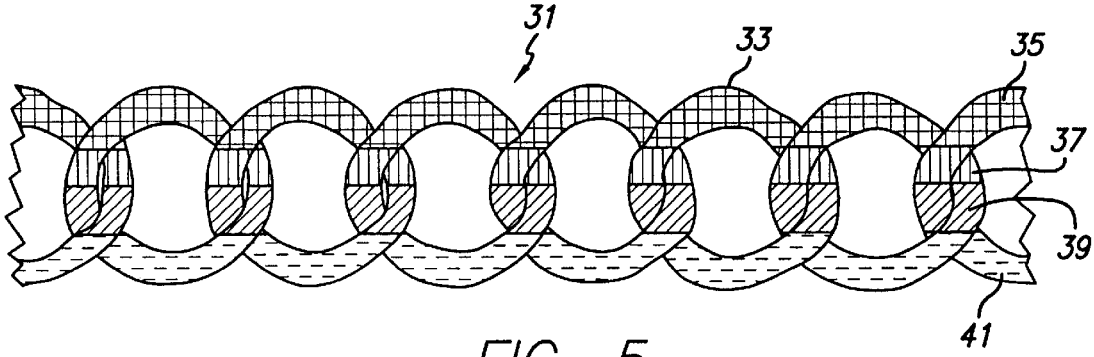
FIG. 5 is a view of the outward appearance of a length of jewelry closed-link chain in accordance with the present invention, similar to that of FIG. 4, in which each link element comprises four differently colored or textured regions.

FIG. 5 also shows a closed-link chain 31, similar to that shown in FIG. 4, except that each link 33 exhibits four different regions or portions, each region or portion shown to have a different color. Link portion 35 is shown to be made of, or plated with, yellow gold, and portions 37, 39, and 41 are likewise shown to be made of, or plated with, pink gold, green gold, and white gold or silver, respectively.

Figure 6:
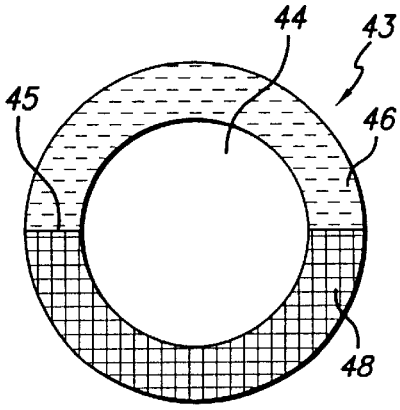
FIG. 6 is a plan view of an individual two-colored or textured closed-link element of the type employed in the manufacture of a closed-link chain in accordance with the present invention.

FIG. 6 is a plan view of a simple annular closed-gap link element 43 which may be assembled into a closed-link chain form and subjected to a compressing procedure to flatten the chain and take on a configuration such as any of those shown in FIGS. 1–5. The link element 43 has an enclosed open area 44, a white gold (or silver) half 46, and a yellow gold half 48. The link element 43 may be produced by stamping a sheet of material comprised of side-by-side joined strips such as that shown in FIG. 7 in which the strip 49 is lined for yellow gold, and the adjacent strip 51 is lined for white gold. Using an annular die cutting arrangement, a series of link elements 43 may be cut from a multicolored strip 47 employing known stamping techniques. At the discretion of the manufacturer, the stamping die used may die cut link elements similar to that of link element 43 having cross section in the shape of a rectangle, a rounded corner rectangle, a circle, an oval, or any desired configuration.

The link element 43 shown in FIG. 6 is referred to as a closed gap link element, in that, either during the stamping operation or subsequent thereto, a cut 45 is made extending from the exterior of the link element 43 to the enclosed open area 44. The cut 45 is also referred to herein as a closed gap, since, while the ends of the link element 43 on either side of the cut 45 are bent relative to one another to open the gap for insertion of a linking portion of another link element, the two ends are brought back together again, i.e. closed, and soldered shut in the final process.

While all representations of link elements in this description show a cut portion, or portions, forming a closed gap, it would require only minor alteration of a standard link element stamping die to, not only form the desired shape of the link element, but also to make a cut during the stamping operation and, additionally, bend one, or both, of the ends of the link element at the gap to an open skewed condition. This will facilitate an efficient assembly of a closed-link chain by avoiding the need for opening the closed gap temporarily after stamping. A craftsman need only to pass a linking portion of another link element through the pre-set open gap and subsequently bring the two ends back to a facing, or closed, position.

Figure 7:
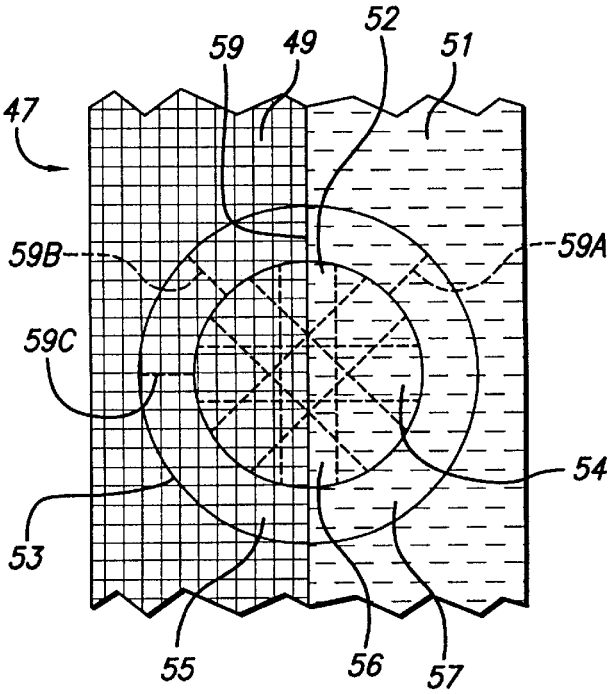
FIG. 7 is a plan view of a partial sheet of material comprised of two differently colored or textured strips, and showing various possible orientations of a stylized stamped link element relative to that of the sheet of material.

It will be noted in FIG. 7 that the link element 53 to be stamped from the sheet of material 47 has a cut, or closed gap, 59 oriented at a twelve o'clock position relative to the two strips 49 and 51 making up the multicolored or textured sheet of material, such that the link element 53 is half the color and/or texture of strip 49, and half the color and/or texture of strip 51. If the stamper die (not shown) is rotated clockwise relative to the sheet of material 47 until the cut, or closed gap, 59A is at the one or two o'clock position, a short portion on the left side of the link element 53 near the closed gap 59A will be of white gold color, while the remainder of the left side will be of a yellow gold color. The opposite is true of the right side of link element 53, i.e., a large segment of the right side adjacent the gap 59A is of a white gold color, while a shorter segment of the right side is of a yellow gold color.

The link element 53 in FIG. 7 is shown to have a dividing member 54 spanning across the link element 53 to define first and second enclosed open areas 52 and 56. A closed-link chain constructed with a series of link elements with two enclosed open areas 52 and 56 will require a closed gap across both top and bottom portions of link element 53, or a single closed gap across only the top or bottom portion. If the former, some link elements need not have a closed gap. If the latter, all link elements will necessarily have a single closed gap.

Third and fourth exemplary positions of the closed gap are shown in FIG. 7 in phantom at 59B and 59C. It is self-evident that the position of dividing member 54 and the yellow and white gold proportions change accordingly.

When a number of link elements 53 are assembled into a closed-link chain, an interesting and attractive color pattern will be observed. That is, with the closed gap positioned at 59, one half of the chain will be of a white gold color, while the other half is yellow, the line of demarcation being parallel to an axis of the chain.

On the other hand, with the closed gap positioned at 59A, one half of the chain will have a predominantly white color with a small portion being of a yellow color, while the other half will be predominantly of a yellow color with a small portion being of a white color. When the closed gap is at 59C in FIG. 7, i.e., perpendicular to the longitudinal length of the colored strips 49 and 51, a pattern of alternating colors will be observed along the length of the assembled chain. If all link elements are oriented in the same direction, a color change will be observed for each link position in the chain. On the other hand, if like-colored halves of each link element 53 are assembled to be interlinked with the same color halves of an adjacent link elements, then the alternating color pattern will be observed at every other link element position along the chain, giving a more pleasing aesthetic look to the chain.

In accordance with the invention, the link elements may be stamped from a multicolored flat sheet comprising a number of edge-joined strips of alternately colored gold materials, of alternate gold karat weights, of alternate material types such as gold and silver, or of alternate textures, or combinations thereof. Such a multicolored flat sheet may be stamped to form link elements in different orientations relative to the strip pattern and relative to the closed gap position, resulting in a limitless variety of interesting colored patterns in the finished closed-link chain, yet all such link elements can be stamped from the same multicolored stripped sheet.

FIG. 8 is a view similar to that of FIG. 7, except that the sheet of material 61 comprises a larger number of colored strips 63–68. The effect of stamping a link element from a multicolored strip of material may be appreciated by reference to FIG. 5 which depicts a closed link chain possessing four different gold colors.

When a craftsman selects a multicolored sheet of material from which to stamp closed gap link elements, not only is a determination made as to the number and colors (or textures) making up the sheet of material, and the orientation of the closed gap, such as closed gap 77 in FIG. 8, but the relative width of the different colored or textured strips 63–68 may be of considerable interest. For example, FIG. 8 shows a yellow gold strip 67 having a width greater than any of those in the chain, while the strip 66, which may be representative of a serrated textured strip, is of a narrower width. Thus, the final assembled chain will advantageously exhibit a large amount of yellow gold, and a hint of a bright and delicate looking serrated stripe, perhaps rhodium plated.

The multicolored strip 79 in FIG. 9 is further illustrative of the virtually limitless color/texture patterns that can be created in the link elements forming a closed-link chain.

For example, the link element 81 stamped from the sheet of material 79 may have two yellow gold portions 85 and 89, and a white gold portion 91. However, if the sheet of material 79 is comprised of a small karat weight strip 95 of yellow gold, a relatively large karat weight yellow gold strip 97, and a white gold strip 99, the resulting link will have the same three constituent materials making up the three regions 85, 89, and 91 of link element 81. A closed-link chain constructed with such link elements will exhibit an appearance nearly identical to one in which only a high karat weight yellow gold is used, but with lower manufacturing cost.

Since all closed gaps, such as closed gap 87, will ultimately be soldered across after assembly of the chain, it is standard procedure to place the soldered closed gap 87 in an inconspicuous place, i.e. at the location where one link element is coupled to another link element. When the closed-link chain is assembled and subjected to a high compression process to flatten the chain into a form such as those shown in FIGS. 1–5, the closed gap will be less apparent or not visible at all. The most visible parts of a closed gap link element in a completed chain are those regions equally spaced from the gap and a point across a diameter of the link element passing through the gap. This would further explain the reason for the placement of the high karat weight gold strip 97 in the center of the multicolored sheet of material 79.

The dashed line 93 shown in FIG. 9 is an indication that, rather than providing two different materials on each side of dividing line 93, a multi colored or textured material may have a single wide yellow gold strip (having the combined width of strips 95 and 97 shown in FIG. 9) and a narrow white gold strip 99. That is, dividing line 93 shows an optional construction for the sheet of material.

FIGS. 10A through 10E are plan views of single-opening closed-link elements showing only representative examples of a limitless number of overall geometrical configuration possibilities. Each of the representative embodiments A-E in FIG. 10 have a single enclosed open area 101A–101E.

As mentioned, during assembly, the closed gaps of link elements are temporarily opened, as by twisting, to permit a linking portion of an adjacent link element to be inserted into the enclosed open area. By definition, the body portion of each link element in the area of the closed gap is referred to herein as a "linking portion". This term is derived from the fact that it is the part of a link element that is able to be inserted into the "enclosed open area" of an adjacent link element. Employing this definition, FIG. 10 shows the linking portions 100A–100E adjacent the associated closed gap.

Of course, for the single enclosed open area link elements A-E shown in FIG. 10, after opening a closed gap of one of the link elements, another closed gap link element, or a no-gap link element, may be threaded onto the first-mentioned link element. As a result, a fully closed, or no-gap, link element will have a portion passing through the enclosed open area of the gapped link element. However, a no-gap link element will not be referred to herein as having a linking portion so as to be clear in the description of assembling a closed-link chain.

FIGS. 11A–11E are plan views of multiple-opening closed-link elements each of which comprises a differently configured dividing member. One of the enclosed open areas are designated 102A–102E, while the other enclosed open area is designated 103A–103E. Different link element designs are shown in FIG. 11, but, nevertheless, each such element has a structure separating the two enclosed open areas.

The dividing, or separating, structures are indicated in FIG. 11 by dividing members 104A–104E. Again, by definition, the linking portions of each of the link elements shown in FIG. 11 are designated 105A–105E. Due to the dividing members 104A–104E, if a closed link chain is constructed of all dual enclosed open area link elements, then, by necessity, each such element will have to have at least one closed gap formed therein leading from the exterior to at least one of the enclosed open areas as defined.

Figure 12:
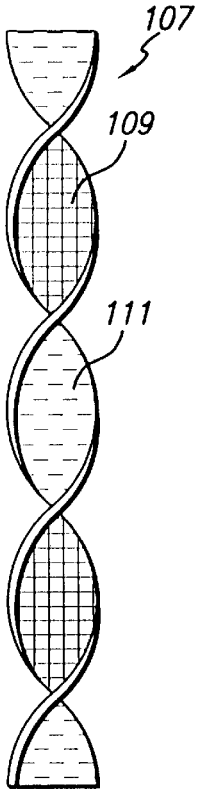
FIG. 12 is a side elevational view a laminated strip of material which is twisted prior to being cut to length and formed into a closed-link element.

FIG. 12 is a side elevational view of a thin laminated strip of material 107 which is twisted and cut to length prior to being formed into a closed-link element. In the specific example shown in FIG. 12, the laminated strip of material 107 has a yellow gold side 109 and a white gold side 111. Such a laminated strip of material may be produced by bonding two layers of thin sheet material together, or by laminating two sheets of material together and slicing off a thin segment. A link element is then formed by bending the thin laminated and twisted segment bringing the ends together in a facing closed gap orientation. Such link element is then assembled, together with other link elements, to form a closed-link chain in the manner previously described.

Figure 13:
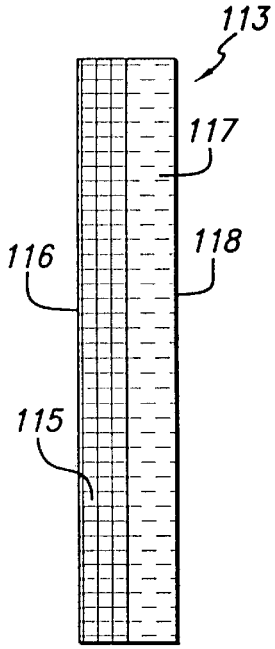
FIG. 13 is an edge view of a link element formed by bending a layered wire, or a slice from a sheet of layered material, such that each major surface exhibits a single color or texture, and the inner and outer edges exhibit multiple colors or textures.

FIG. 13 shows a layered link element 113 formed of a yellow gold layer 115 and a white gold layer 117, thereby presenting a yellow gold major surface 116 and a white gold major surface 118. Link element 113 may be fabricated by bending a slice of laminated material such as that at 127 in FIG. 15, yet to be described. In FIG. 13, each major surface 116, 118 exhibits a single color or texture, and the inner and outer edges (inner edge not visible in FIG. 13) exhibit multiple colors or textures.

Figure 14:
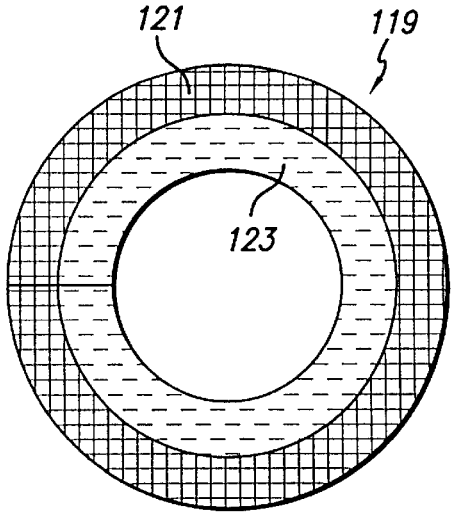
FIG. 14 is a plan view of a link element formed by bending a layered wire or a slice from a sheet of layered material such that the major surfaces exhibit multiple colors or textures, and the inner and outer edges each exhibit a single color or texture.

FIG. 14 shows a layered link element 119 having a yellow gold outer layer 121 and a white gold inner layer 123. Link element 119 may be fabricated by bending a slice of a laminated sheet of material such as that shown at 127A in FIG. 15, yet to be described. In FIG. 14, each major surface exhibits multiple colors or textures, and the inner and outer edges each exhibit a single color or texture.

Figure 15:
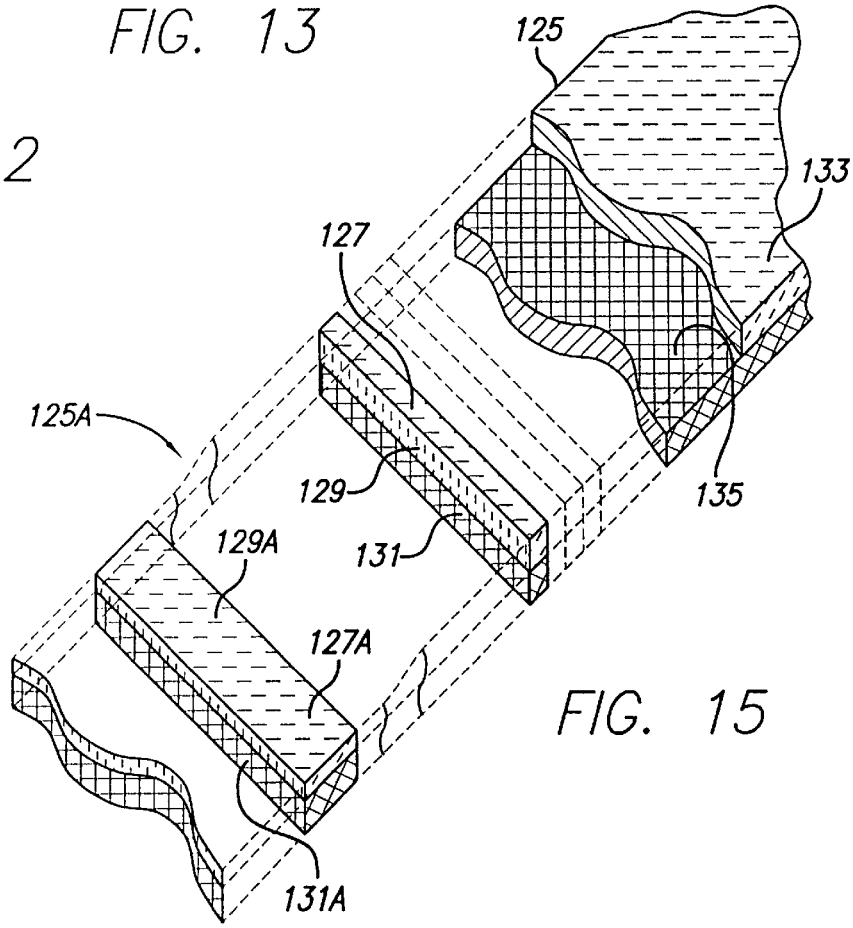
FIG. 15 is a perspective view of a partial laminated sheet of material from which slices can be cut and eventually formed into a link element similar to that shown in FIG. 13 or 14.

FIG. 15 is a perspective view of a laminated sheet of material 125 comprised of, for example, a layer of white gold 133 and a layer of yellow gold 135, or both layers 133, 135 can be of yellow gold of different gold karat weights. In a stamping or die-cutting process, slices 127 can be cut from the sheet of layered material 125 and eventually formed into a link element by a bending or rolling process to be described hereinafter with reference to the forming method depicted in the action perspective view of FIG. 16, and with reference to the layered link elements shown in FIGS. 12–14.

While FIGS. 12–15 depict one color representing yellow gold and the other color representing white gold or silver, it may be desirable to laminate together two yellow gold layers of different gold karat weights. If the two layers 133, 135 are both yellow gold of different karat weights, 7K and 14K for example, and if the assembly operation and compression operation are set up in a particular fashion, the visual impression of a finished closed-link chain will be essentially that of a 14K gold closed-link chain, giving a purchaser the desired visual quality at lower cost.

In this connection, FIGS. 12–14 are concerned with the forming or shaping of a strip of material into the configuration of a link element after the strip has been sliced, e.g. die-cut, from a sheet of material. The sheet of material 125 in FIG. 15, as noted above, may be sliced to form a strip 127 and bent into annular shape to produce the layered link element shown in FIG. 14.

It should be noted that, depending upon the choice of material thickness and width of the slices 127 and 127A, the slices 127 and 127A can be bent in any of four different directions: to produce a major surface with either material 133 or 135 and the other major surface with the other material (or both yellow gold of different gold karat weights, cf. FIG. 13 and FIG. 6 of the aforementioned U.S. application Ser. No. 09/287,972); or to produce a major surface having the interior edge of one material 133 and the exterior edge of the other material 135, or visa versa (cf. FIG. 14 and FIG. 49 of the aforementioned U.S. application Ser. No. 09/287,972).

FIG. 15 is illustrative of two thicknesses of laminated materials 133 and 135 on either side of a transition region 125A permitting construction of link elements of the two types just described. The transition region is depicted for ease of description only. In practice, a single thickness of laminated material will be chosen, at the discretion of the jewelry designer and manufacturer.

For example, it will be appreciated that the sheet of material 125 has a thickness greater than the width of the slice 127, and comprising a white gold strip layer 129 and yellow strip layer 131, so that the link element formed by bringing the ends of the strip 127 upwardly around a mandrel will produce a link element similar to that shown in FIG. 14 of the desired physical dimensions for the construction of a closed-link chain.

An alternative preferred method is to provide a thinner sheet of material 125 such as that shown below the transition 125A in FIG. 15, and die cutting strips 127A of wider dimension, as shown, with the top strip layer 129A of white gold and the bottom strip layer 131A of yellow gold. This method has two advantages. First, it is easier to die-cut a strip from a thin material than it is from a thicker material. Secondly, since a link element formed by bending the strip 127A requires that the ends of the strip 127A as shown in FIG. 15 to be bent in the plane of the paper about a mandrel, this permits the stamping/die-cutting procedure to form edge patterns on both the front and rear edges of the strip 127A to enhance the appearance of the finished link element.

It has been suggested herein that closed links may be slightly twisted out of the plane of the link to create an open gap for purposes of assembly into a chain. After the linking portion of one link element is inserted into the open area of an adjacent link element, the link is twisted in the opposite direction to close the gap. An alternative procedure is to manufacture the link elements to have a gap, similar to that of a rope chain link element, wide enough to receive the thickness of an adjacent link element, and, after assembly of the two links, compress the first link to close the gap and form a closed-link chain segment as herein described.

Figure 16:
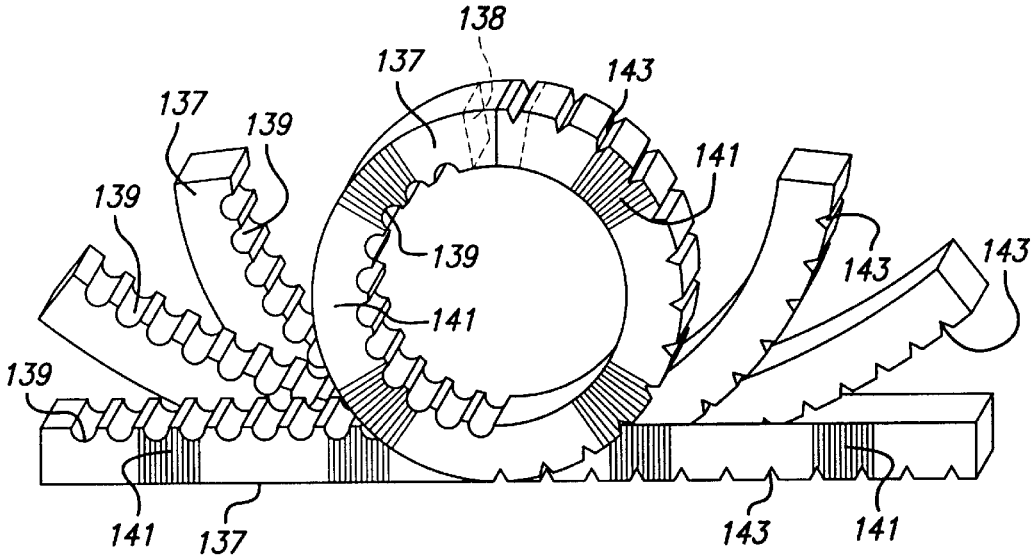
FIG. 16 is an action perspective view showing four time positions of a slice of material, or a wire, illustrating the bending positions of a straight textured and shaped slice or wire into the configuration of a closed-link element.

Stamping is merely one method of fabricating link elements for the manufacture of closed-link chains. Link elements can also be made from wire. As indicative of "stamping", different visual properties can first be made on the wire prior to the making of the link element. FIG. 16 shows a portion of a wire, or a slice of material, laminated or not, or a prepared strip 137 that can be made into an annular link element for the purpose of making closed-link chains with a distinctive and decorative design. The removal or omission of material from the wire, slice, or strip, as shown, has an additional benefit of saving precious metal resulting in a lowered cost of materials.

FIG. 16 is an action perspective view showing four time positions of a slice of material, prepared strip, or wire 137, and illustrating the bending of a straight textured and shaped slice, wire, or strip into the configuration of a link element having a prescribed length, width, and thickness.

As can be seen in FIG. 16, a rather scalloped design of impressions 139 may be formed on any portion of a strip of material 137 which, after forming of the link element, produces a notched interior edge 139. Similarly, the right bottom side of the strip 137 may have V-grooves 143 formed therein so that the formed link will have the V-grooves 143 on its outer peripheral edge. Using any of the process steps mentioned above, the sides of the strip 137 may also be provided with a pattern or textured regions 141 which then show as textured regions on the major surface or surfaces of the ultimately produced link element.

Although it has been adequately described earlier in this specification, the notches 139, V-grooves 143, and side serrations or textured patterns 141 of the link element shown in FIG. 16 all contribute to removing precious metal from the otherwise solid annular ring-shaped link element. As a result, not only is precious metal conserved without diminishing the structural integrity of the link element, but interesting patterns of the closed-link chain from which the link elements are made can be produced as described herein.

As mentioned above, wires made of precious metals may be employed for the manufacture of closed gap link elements to be assembled into a closed-link chain. Forming a wire into a link element for the construction of chains is a widely known procedure. However, in order to meet a primary objective of the present invention, a wire to be formed into a link element must have a plurality of regions of differing colors and/or textures. The system 151 shown schematically in FIG. 17 accomplishes this objective.

Figure 17:
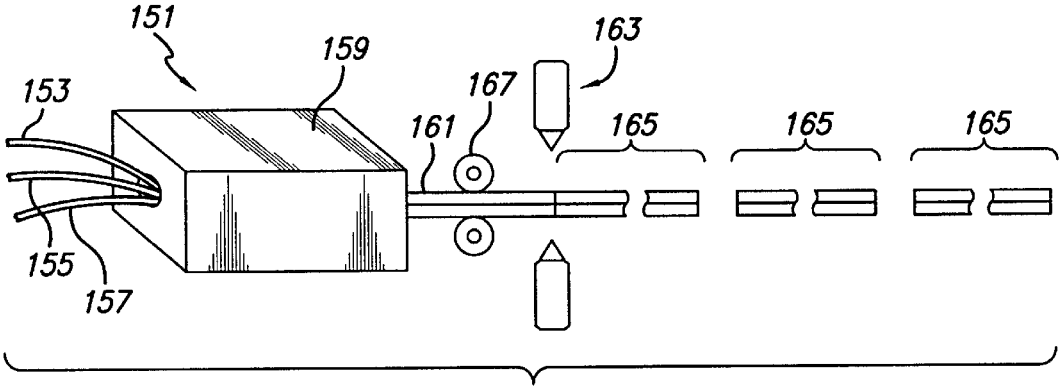
FIG. 17 is a schematic representation of a wire forming apparatus for receiving a plurality of thin wires and forming and cutting into lengths a larger compound wire.
Figure 18:
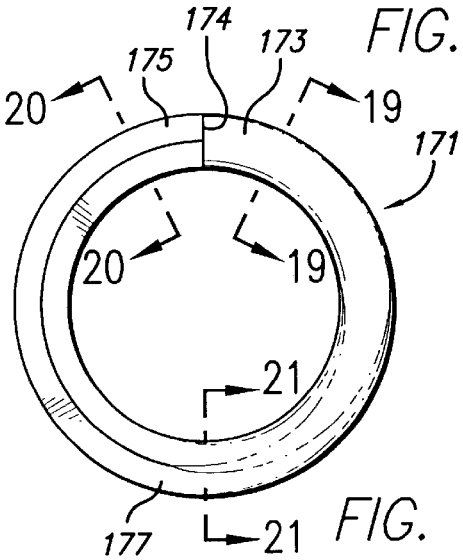
FIG. 18 is a plan view of a closed-link element which has a variable cross section along its length.
Figure 19:
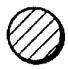
FIG. 19 is a cross sectional view of the closed-link element shown in FIG. 18 taken along the lines 19—19.
Figure 20:
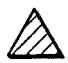
FIG. 20 is a cross sectional view of the closed-link element shown in FIG. 18 taken along the lines 20—20.
Figure 21:
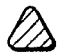
FIG. 21 is a cross sectional view of the closed-link element shown in FIG. 18 taken along the lines 21—21.

As seen in FIG. 17, a plurality of relatively thin wires 153, 155, 157, each having a distinguishable visual property, such as color or material type or karat weight, are fed into a compounding unit 159 which may employ known compression and bonding techniques to form a compound, larger diameter wire 161 at its output. To bond the thin input wires 153, 155, 157, compression rollers, sonic vibrators, heat application, and the like may be employed, or any combination thereof, to bond the three incoming wires into a bonded combined compound wire 161. The details of the mechanics and physics to bond the three wires together is left to the discretion of the manufacturer who has all of these known methods available depending on the desired methodology.

After the bonded compound wire 161 exits the unit 159, it may be, optionally, subjected to a texturing process represented in FIG. 17 by a pair of opposing rollers 167.

After any optional texturing is applied to the compound wire 161, a wire cutting arrangement 163 cuts the compound wire into predetermined lengths to form a multicolored and/or multi-textured link element 165.

While link elements with flat major surfaces and cylindrical side walls have been used as exemplary in the preceding text, it is within the scope of the invention to form a stamping die, or complementary pair of stamping dies, for a stamping machine, and form closed-link elements having a variable cross section along its extent. An example is depicted in FIGS. 18–21 which show, respectively, a plan view of a closed-link element 171 having a variable cross section, a cross sectional view taken adjacent one side of the closed gap 174, a cross sectional view taken adjacent the opposite side of the closed gap 174, and a cross sectional view taken directly across from the closed gap 174.

In this embodiment, the cross section of link portion 173 is circular, the cross section of link portion 175 is triangular, and the cross section of link portion 177 is generally triangular with rounded corners.

Preferably, the cross section of link element 171 is continuously variable along the extent of the link element 177, and in this specific example the circular cross section on one side of the gap 174 is morphed into a triangle at the other side of the gap 174. Alternatively, for an interesting visual effect, the change in cross section may be incremental, not continuous, staying the same for a short distance and changing in discrete steps along the extent of the link element 171.

It is to be understood that the cross sectional variation may be a morphing or stepped change from any geometrical shape to any other geometrical shape, such as square, diamond shaped, D-shaped, oval, polygonal, or even a non-geometrical or random shape. Likewise, a link element with a variable cross section is not limited to annularly configured link elements, and can be of any configuration including those described herein.

Figure 22:
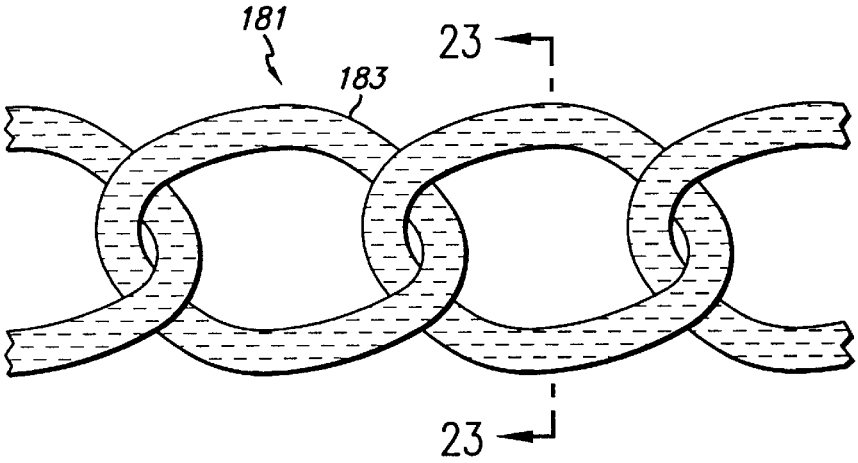
FIG. 22 is an elevational view of a length of closed-link chain, the side of the chain in view being lined for the color white gold or silver.

FIG. 22 is an elevational view of a length of closed-link chain 181 comprised of closed-link elements 183. The side of the chain in view is lined for the color white gold or silver. The opposite side, not in view in FIG. 22, is yellow gold in color, as evident from the cross sectional view of the chain shown in FIG. 23. The embodiment of link element shown in FIGS. 22 and 23 is similar to the layered link element shown in FIG. 13, but with the cross section being circular instead of rectangular.

Figure 23:
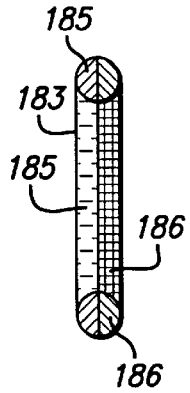
FIG. 23 is a cross sectional view of the closed-link chain shown in FIG. 22, taken along the line 23—23.

By constructing a closed-link chain as shown in FIGS. 22 and 23, a person can wear the same bracelet or necklace on one night, displaying a white gold or silver color, and flip it over on another night, displaying a yellow gold color, to give the impression it is another bracelet or necklace. Alternatively, the person can chose one side or the other to be exposed, depending upon the other jewelry items being worn, or depending upon the choice of fashion wear.

Figure 24:
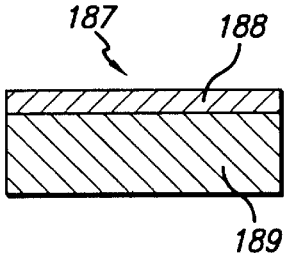
FIG. 24 is a cross section of a closed-link chain link element made of two different materials.

A specific example of a link element suitable for assembly into the multicolored chain 118 of FIGS. 22 and 23 is seen as link element 187 in FIG. 24. Link element 187 is dual layered, but the thin top layer 188 is of yellow gold, while the thick bottom layer 189 is of silver. As a result, the aforementioned two-color effect is made possible while at the same time saving manufacturing material costs.

Figure 25:
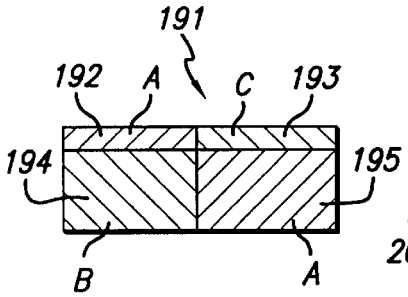
FIG. 25 is a cross section of a closed-link chain link element made of four different materials.
Figure 26:
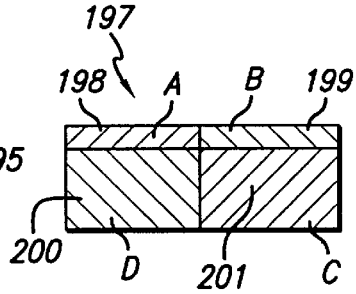
FIG. 26 is a cross section of a closed-link chain link element made of three different materials among four cross sectional segments.

FIGS. 25 and 26 are cross sections of closed-link link elements 191, 197, respectively, having four different segments making up the cross section.

In FIG. 25, the link element 191 may be constructed by bonding two materials to form a thin multilayered structure, similar to that shown in FIG. 13, in which a major surface of a relatively thin yellow gold annular ring 192 (corresponding to layer 115 in FIG. 13) is bonded to relative thicker silver annular ring 194 (corresponding to layer 117 in FIG. 13). Such a dual layered construction defines an outer annular ring portion 192, 194.

Similarly, an inner annular ring portion 193, 195 is constructed in the same manner, but with different materials and with a smaller overall configuration radius. A four-segment link element 191 is then formed by bonding the inner dual layered annular ring portion 193, 195 to the outer dual layered annular ring portion 192, 194. In the example shown, the segments in FIG. 25 are designated A, B, and C representing three different materials for the four segments 192–195. To keep manufacturing costs down, segment C can be chosen to be made of an expensive material, segment B can be chosen to be made of an intermediate cost material, and segment A can be chosen to be made of the least expensive or rare materials.

FIG. 26 is a cross section of a closed-link chain link element 197 made of four different materials among the four cross sectional segments 198–201. Here, segments A and B can be of relatively more expensive materials, and segments C and D can be less expensive materials.

Figure 27:
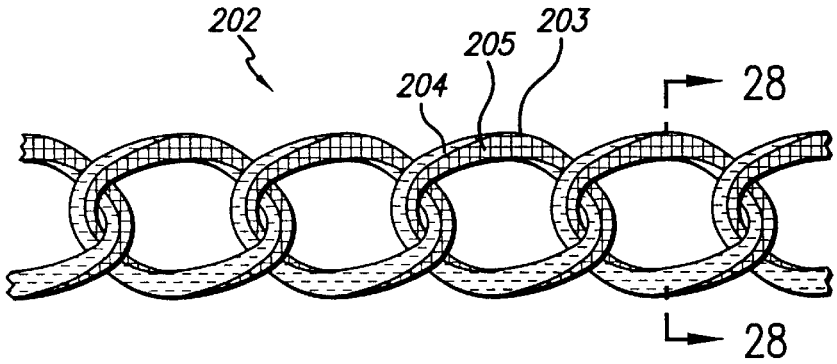
FIG. 27 is an elevational view of a length of closed-link chain, the side of the chain in view being lined for the colors white gold or silver and yellow gold.

FIG. 27 is an elevational view of a length of closed-link chain 202, the side of the chain in view being lined for the colors white gold or silver and yellow gold. Each link element 203 is of two-layered construction similar to that of FIG. 13, but is subjected to a full single twist prior to being closed (reference FIG. 12). After a length of chain 202 is assembled, pressed, and twisted, one longitudinal side of the chain 202 parallel to a centerline exhibits a primarily white gold or silver color (top half of chain 202 in FIG. 27), while the other longitudinal side of the chain exhibits a primarily yellow gold color (bottom half of chain 202 in FIG. 27).

Figure 28:
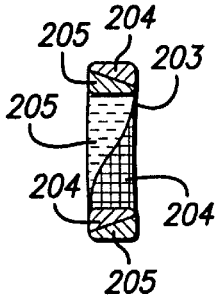
FIG. 28 is a cross sectional view of the closed-link chain shown in FIG. 27, taken along the line 28—28.

FIG. 28 is a cross sectional view of the closed-link chain 202 taken along the line 28—28 in FIG. 27, to aid in understanding the link element and resulting chain construction.

Figure 29:
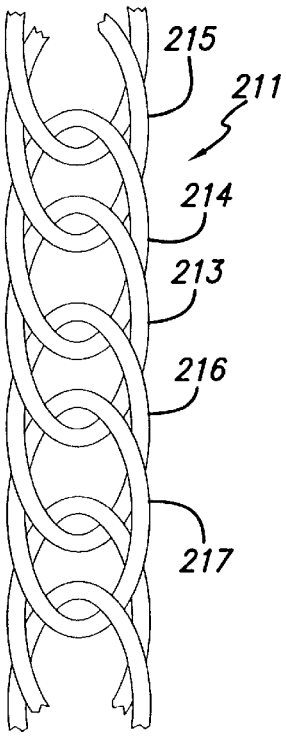
FIG. 29 is a flat schematic representation of an assembly of link elements which, depending on shapes, sizes, and pressing and/or twisting, is the basis for the manufacture of a variety of different closed-link chains.

FIG. 29 is a flat schematic representation of a double closed-link chain 211, named because, instead of each link element, e.g. 213, having a single adjacent link element passing through it on both ends along the chain, it has two link elements 214, 215 and 216, 217 passing through it on both ends, i.e., each link element has a total of four adjacent and next-adjacent link elements passing through its center opening.

FIG. 29 is schematic, in that it shows only the arrangement of link elements relative to one another along the chain. The figure does not account for thicknesses of link elements which will, of course, cause each link element to have an angular relationship with its neighbor. That is, the chain so produced by the indicated assembly method, without being flattened by a press, will have the appearance of intertwining strands of rope. The similarity to a double helix rope is dependent on shapes, sizes, and pressing and/or twisting of the link elements prior to assembly, and/or the amount of pressing and twisting of the assembled chain. In any event, the assembly concept shown in FIG. 29 is the basis for the manufacture of a variety of different closed-link chain styles.

Figure 30:
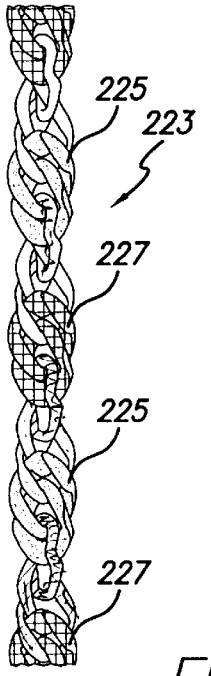
FIG. 30 is an elevational view of a length of closed-link chain known as Singapore chain, the opposite flattened sides of the chain being lined to show different textures or colors, respectively.

For example, FIG. 30 is an elevational view of a length of closed-link chain 223 known as Singapore chain, the assembly construction of which is the same as that shown in FIG. 29. In FIG. 30, the opposite flattened sides 225, 227 of the twisted chain 223 are lined to show different textures or colors.

Figure 31:
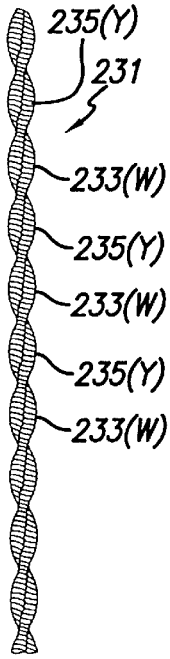
FIG. 31 is an elevational view of a length of tightly twisted Singapore chain, emphasizing a double helix effect for the opposite thin edges of the chain, the two helixes being lined for the colors white gold or silver and yellow gold, respectively.

FIG. 31 is an elevational view of a length of tightly twisted Singapore chain 231, emphasizing a double helix effect for the opposite thin edges 233, 235 of the chain 231, the edges 233, 235 of the two helixes being of white gold (or silver) and yellow gold. In FIG. 31, and in FIGS. 33–35 to follow, due to the small size of the chain and link elements shown, color or texture lining is not practical, and thus a letter "Y" or "W" is used to indicate regions that are of a yellow gold color, "Y", or of a white gold (or silver) color, "W".

Figure 32B:
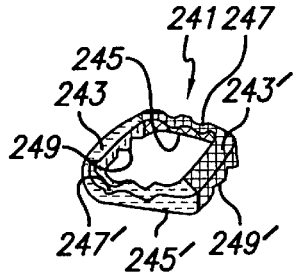
FIG. 32B is a perspective view of a link element taken from the length of chain shown in FIG. 31 and showing another color or texture pattern.
Figure 32A:
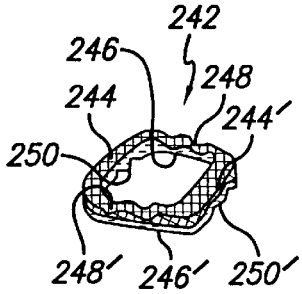
FIG. 32A is a perspective view of a link element taken from the length of chain shown in FIG. 31 and showing a color or texture pattern.

FIG. 32A is a perspective view of a link element 242 taken from the length of chain 223 shown in FIG. 30 and showing a different color or texture pattern for each link major surface, as will be described below.

Link element 242 has two upper flat surfaces 244, 244' and two lower flat surfaces 246, 246', formed during the flattening process by an appropriate pressing device after assembly of the chain 223. These flat surfaces are those portions of the link element that contact the press plates. There are also two deformed upper surfaces 248, 248' and two deformed lower surfaces 250, 250', also formed during the flattening process. Such deformed surfaces result from crossing portions of adjacent link elements being crushed under pressure from the press. Since deformed surfaces mate with other deformed surfaces in the chain, they are not visible, and the appearance of the chain is that of a single twisted flat ribbon, as is clearly evident from FIGS. 30 and 31.

However, the link element 242 in FIG. 32A is patterned after that of FIG. 13 in which the upper half of the link element 241 is of yellow gold, and the lower half is of white gold or silver, surfaces 244, 244', 248, and 248' being lined for yellow gold, and surfaces 245, 245', 250 and 250' being lined for white gold or silver in FIG. 32A. Thus, the opposite flattened sides 225, 227 of chain 223 exhibit the desired effect with one flat side 225 of the ribbon-like chain 223 being of one color or texture, and the other flat side 225 being of another color or texture. An alternating texture or color pattern is therefore seen along the length of the twisted chain.

FIG. 32B is a perspective view of a link element 241 taken from the length of chain 231 shown in FIG. 31 and showing a different color or texture pattern for each link half, as will be described below.

Link element 241 has two upper flat surfaces 243, 243' and two lower flat surfaces 245, 245', formed during the flattening process after assembly of the chain 231. There are also two deformed upper surfaces 247, 247' and two deformed lower surfaces 249, 249', also formed during the flattening process. Since deformed surfaces mate with other deformed surfaces in the chain, they are not visible, and the appearance of the chain 231 is that of a single twisted flat ribbon, as is clearly evident from FIGS. 30 and 31.

However, the link element 241 in FIG. 32B is patterned after that of FIG. 6 in which the left half of the link element 241 is of white gold or silver, and the right half is of yellow gold, surfaces 243', 245, 247, and 249, being lined for yellow gold, and surfaces 243, 245', 247' and 249 being lined for white gold or silver in FIG. 32B. Thus, the opposite edges 233, 235 of chain 231 exhibit the desired double helix appearance, i.e., one helix defined by edges 233 is of one color or texture, and the other helix defined by edges 235 is of another color or texture.

Figure 33:
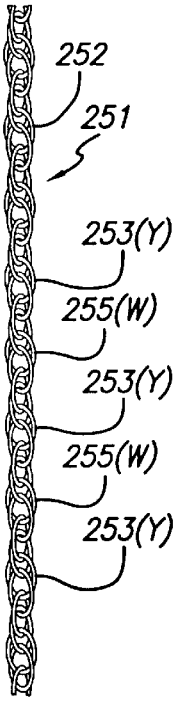
FIG. 33 is an elevational view of a length of closed-link chain known as French Rope chain, the arrangement of link elements forming a double helix along the chain and having the appearance of intertwined helical rope strands of different colors or textures.

FIG. 33 is an elevational view of a length of closed-link chain 251 known as French Rope chain, the arrangement of link elements 252 following the assembly scheme shown in FIG. 29. Since each link element 252 is very small in cross section relative to the link size, and since there is no flattening process applied to the chain 251 after assembly, the general appearance of the chain 251 is that of a double helix rope, i.e., of intertwined helical rope strands. Choosing any of the virtually limitless number of color and/or texture combinations for the stamping of each link element 252, examples of which are shown in FIGS. 6–9, 13, 14, 16, and 17–21, and in the aforementioned jewelry chain family of copending patent applications, French rope chains can exhibit a similarly limitless combination of colors and/or textures along the length of chain 251. For example, one helical strand 253 may be of a different color or texture (e.g., yellow gold) from the other helical rope strand 255 (e.g., of white gold or silver).

Figure 34:
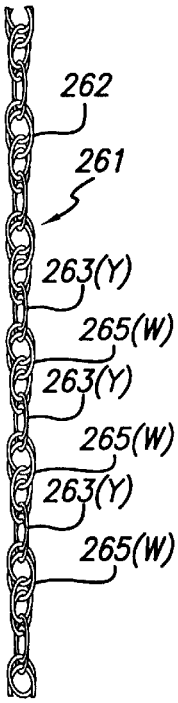
FIG. 34 is an elevational view of a length French Rope chain, similar to that shown in FIG. 33, twisted in one axial direction, thereby displaying a more well defined double helix along the chain.
Figure 35:
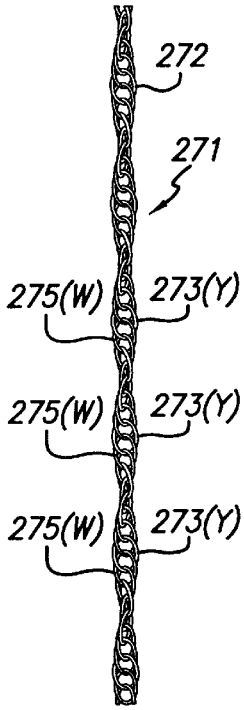
FIG. 35 is an elevational view of a length of French Rope chain, similar to that shown in FIG. 33, twisted in the opposite axial direction, thereby displaying an even more well defined double helix along the chain.

Due to the small size of the link elements comprising the chains of FIGS. 33–35, it is not practical to show color and/or texture lining or other visual property characteristics for the individual link elements. However, having shown several chains with unique and different colorization and/or texturing in the accompanying drawings and in the aforementioned copending patent applications, it will be self evident to a person of ordinary skill in the art to visualize the colorization and/or texturing effects when employing colored and/or textured link elements for the embodiments shown in FIGS. 33–35. However, each rope strand identified in FIGS. 33–35 is labeled with "(Y)" or "(W)" to indicate yellow gold or white gold (or silver), respectively.

It is to be understood, that, while only two colors or textures are shown in FIGS. 22–24, 27, 28, and 30–35, the number of colors, textures, and combinations of colors and textures can be much greater than two and is limited only by practical considerations.

The individual link elements of the French rope chain of FIG. 33 are loose, i.e., not soldered to retain any special configuration. Accordingly, in its natural state, with the link elements 252 necessarily continuously incrementing in angular position along the chain 251, a natural double helix rope effect is presented, with the attractive feature that the chain is very delicate, since there is nothing to hold the links close together in close proximity.

FIG. 34 is an elevational view of a length French Rope chain 261, similar to that shown in FIG. 33, twisted in one axial direction, e.g. counterclockwise, thereby displaying a more well defined double helix along the chain.

The French rope chain 261 of FIG. 34, however, is twisted in a direction to tighten the naturally formed helix and is set in the twisted state by a number of soldering spots. As a result, the chain 261 is not as delicate appearing as chain 251. On the other hand, by the twisting action, the helical rope strands 263 and 265 are more defined, and the pitch of the twists of the rope chain is smaller than that when the chain is in a loose condition.

FIG. 35 is an elevational view of a length of French Rope chain 271, similar to that shown in FIG. 33, twisted in the opposite axial direction, e.g. clockwise, thereby displaying an even more well defined double helix along the chain.

The French rope chain 271 of FIG. 35 is twisted in a direction to loosen the naturally formed helix and is set in the twisted state by a number of soldering spots. As a result, by the twisting action, the helixes 273 and 275 are much more defined, and the pitch of the twists of the rope chain is larger than that when the chain is in a loose condition as shown in FIG. 33.

Although physical construction of the chains shown in FIGS. 29–35 are known in the prior art, the unique colorization and/or texturing of the link elements according to any of the suggested schemes described and shown in this specification and accompanying drawing, render such chains similarly unique and visually attractive in the various color and/or texture patterns exhibited by lengths of chain constructed from an assembly of such link elements.

While only certain embodiments have been set forth, alternative embodiments and various modifications will be apparent from the above description to those skilled in the art. These and other alternatives are considered equivalents and within the spirit and scope of the present invention.

For example, portions of a completed closed-link chain may be diamond cut and coated with rhodium or other material. By constructing a closed-link chain using, in part or in whole, serrated, scored, or knurled, link elements, and subsequently rhodium coating diamond cut surfaces, a dramatic increase in contrast is seen due to the softer yellow gold color of the serrated, scored, or knurled portions and the mirror-like finish of the coated diamond cut portions of the chain. Diamond cutting techniques can be easily adapted to the methods of the present invention, especially for those embodiments in which a sheet of material is pre-textured prior to stamping out link elements therefrom.

As has been suggested by the various embodiments and variations of the invention presented herein, the flexibility of design, appearance, and feel of a closed-link chain manufactured using the link elements shown and described can stimulate a myriad of possibilities. These attributes of a completed closed-link chain can be unique with the present invention. Creating similar attributes using prior art techniques would not be considered by the person of ordinary skill in the art, since all attempts to similarly shape, color, texture, or pattern a closed-link chain after it is completed would not be practical. The uniqueness of a closed-link chain employing the link elements of the present invention is made possible by the provision of forming, shaping, coloring, texturing, or otherwise processing individual link elements prior to assembly. Exclusive finished closed-link chain attributes made possible with the present invention cannot be duplicated by applying post-assembled processing steps, whether a single type link element is used throughout the length of the closed-link chain, or multiple types of link elements are assembled in a particular or random order.

As suggested herein, any visual property, as defined herein, may be combined with any one or more other visual properties in the manufacture of the various link elements making up the completed closed-link chain. Visual properties of any one portion of a link element, or of a closed-link chain, may ;include at least one of the group consisting of color, material, different gold karat weights, texture, shape, reflectivity, pattern, size, and design.

One object of the invention is to reduce the amount of material making up the individual link elements to reduce manufacturing costs, while not detracting from the beauty and effective size (diameter) of the finished closed-link chain. Reducing material can be accomplished in many ways: by removing material from or forming edge depressions in the entire or portions of the exterior edge; by removing material from or forming edge depressions in the entire or portions of the interior edge; by removing material from or forming surface depressions in one or both major link surfaces; by forming openings in or through the major link surfaces; or otherwise narrowing the width of the entire or portions of the link elements.

Link thickness, as used herein, is defined as a distance between and perpendicular to the plane of the first and second major surfaces, and at least some of the link elements in a closed-link chain may have an irregular link thickness along the extent of the link element. Link elements that bear surface ornamentation on each link element will cause a closed-link chain to have a more decorative design than the conventional closed-link chain and yet use less precious metal than one without such irregular link thickness.

The embodiments of the invention shown in the figures provide a basis for appreciating the virtually limitless number of configurations and shape and design patterns that can be produced in a closed-link chain structure by employing and creatively arranging the differently colored, patterned, textured, and/or shaped link elements such as those depicted in the accompanying drawings. Further variations and combinations of color patterns, textures, shapes, and configurations are possible and presumed to be within the teaching of the present invention.

Obviously, color, shape, texture, and overall configurations other than those shown in the accompanying figures are possible for the manufacture of the link elements, and these are merely examples of preferred visual property combinations which can produce striking results in a finished closed-link chain construction. For example, an interesting variation of an undulated shaped edge would be a scalloped edge. Accordingly, it is to be understood that the shape and design patterns shown in the accompanying figures, the types of materials used, the coloring, surface texture, surface patterns, arrangement of a series of link elements along the closed-link chain randomly assembled or in strict accordance with a repeated pattern, and the like are all contemplated possibilities and are to be considered within the scope of the present invention.

While the colors and precious metals used in the descriptions herein are preferred to be yellow, white, rose, and green gold, other colors and metals, or even non-metals, can be employed in the construction of the disclosed closed-link chain configurations. Notable alternate materials, for example, are rhodium (in various colors), silver, and nickel, either solid or plated. Colored coatings may also be applied, such as enamel or powder coating.

Several references to rhodium coating have been made in this description. It is to be understood that virtually any part of a finished closed-link chain, constructed from any of the link elements shown in the accompanying figures can be rhodium or gold plated, or coated with any other preferred material or substance. Alternatively, if a closed-link chain is made without the application of heat to weld, or otherwise attach, adjacent link elements together, rhodium (or other material or substance) coating can be applied to the individual link elements prior to assembly, saving much labor expense which would otherwise be required with post assembly coating processes.

Rhodium, gold, or other precious metal plating may be applied by a variety of commonly known plating equipment and processes. For methods and equipment to plate assembled closed-link chains, reference is made to Pro-Craft® Pen Platers, No. 45.400 and No. 45.403 available from Gorbet USA® Tools, Supplies and Equipment for Technicians and Craftsmen, through NK Supply, Inc. Jewelry Supplies 608 S. Hill St. Suite 602, Los Angeles, Calif. 90014. These pen platers can use formulated pen plating solutions, also available from Gorbet USA®, such as Gorbet USA® No. 45.414 Pro-Craft® plating solution, for plating rhodium. Other pen plating solutions are available for plating metals other than rhodium plating solutions. For example Gorbet USA® Nos. 45.410 through 45.412 are Pro-Craft® gold plating solutions, and No. 45.415 is a Pro-Craft® black rhodium plating solution.

Another method for plating rhodium, gold, or other precious metal on only selected portions of an assembled closed-link chain involves three major steps: protective coating all areas of an assembled closed-link chain that are not to be plated; immersing the partially protected chain in a plating bath (e.g., an electro-plating bath); and removing the protective coating. This results in a chain having some non-plated areas (that were protected) and some plated areas added by the plating process. This method is a widely known and therefore does not warrant listing sources for plating materials or plating equipment.

In lieu of rhodium or gold plating, the link elements, prior to assembly, and/or the exterior surface, or portions of the exterior surface, of one or both closed-link strands of an assembled length of closed-link chain can be colorized by a blackener process, by an oxidizer process, or by applying and curing a hard colored enamel. The above-mentioned Gorbet USA® source supplies Jax® Blackeners such as No. 45.906, Vigor® Oxidizers such as No. 45.0329, and Ceramit™ low temperature curing, hard enamels such as No. 45.800.

All of the above-mentioned plating, blackening, oxidizing, and enameling processes result in either a visually attractive color coordinated length of closed-link chain, or a closed-link chain in which the different colors exhibited are in much greater contrast than conventional closed-link chains without any post assembly surface colorization.

In the examples herein showing segmented link elements with one side having different physical characteristics than the other side, the drawings and accompanying text referred to the transition being opposite the placement of the gap. It is within the scope of the present invention to provide segmented regions having different physical characteristics or visual properties as described herein placed in other positions along the extent of the link elements.

All of the above, and other, alternatives are considered equivalents and within the spirit and scope of the present invention.

What is claimed is:

1. A method of manufacturing a link element of the type that is assembled with other link elements to form a closed-link chain in which each of said link elements has an enclosed open area therein through which a linking portion of an adjacent link element may pass, said method comprising:

providing a sheet of material having a plurality of regions adjacent ones of which exhibit different visual properties; and stamping, with a stamping device, a link element from said sheet, forming at least one enclosed open area in said link element for receiving a linking portion of an adjacent link element in a subsequent assembly operation, the link element so produced comprising segments of at least two of said plurality of regions.

2. The method as claimed in claim 1, wherein:

said stamping operation comprises forming a cut across a portion of said link element, said cut extending from an outside edge of said link element to one of said at least one enclosed open areas, said cut link element portion defining a linking portion adaptable to pass through an enclosed open area of an adjacent link element in a subsequent assembly operation.

3. The method as claimed in claim 1, comprising, before stamping, orienting the stamping device, relative to said sheet of material, to achieve a predetermined positional relationship between said sheet of material and said stamping device to thereby produce a link element with variably selectable multiple segments of different visual properties.

4. The method as claimed in claim 1, wherein said regions exhibiting different visual properties are elongated regions adjoined along longitudinal side edges thereof.

5. The method as claimed in claim 1, wherein each of said different visual properties is at least one visual property selected from the group consisting of different colors, different surface textures, different shapes, different sizes, different reflectivities, different gold karat weights, and different materials.

6. The method as claimed in claim 1, wherein said stamping operation includes stamping said link element to have a second enclosed open area and a dividing member separating said enclosed open areas.

7. The method as claimed in claim 5, wherein providing a sheet of material includes forming a surface texture on at least one of said regions by employing at least one process selected from the group consisting of serrating, scoring, knurling, lining, patterning, pressure stamping, impressing, sandblasting, etching, shaping, polishing, matting, frosting, and diamond cutting.

8. The method as claimed in claim 5, wherein:

said regions exhibiting different visual properties include regions having different surface textures superimposed on regions of different colors; and providing a sheet of material includes forming a surface texture on at least one of said regions by employing at least one process selected from the group consisting of serrating, scoring, knurling, lining, patterning, pressure stamping, impressing, sandblasting, etching, shaping, polishing, matting, frosting, and diamond cutting.

9. The method as claimed in claim 5, wherein:

said regions exhibiting different visual properties include regions having different surface textures superimposed on regions of different reflectivities; and providing a sheet of material includes forming a surface texture on at least one of said regions by employing at least one process selected from the group consisting of serrating, scoring, knurling, lining, patterning, pressure stamping, impressing, sandblasting, etching, shaping, polishing, matting, frosting, and diamond cutting.

10. The method as claimed in claim 5, wherein:

said regions exhibiting different visual properties include regions having different surface textures superimposed on regions of different materials; and providing a sheet of material includes forming a surface texture on at least one of said regions by employing at least one process selected from the group consisting of serrating, scoring, knurling, lining, patterning, pressure stamping, impressing, sandblasting, etching, shaping, polishing, matting, frosting, and diamond cutting.

11. The method as claimed in claim 2, comprising, before stamping, orienting the stamping device, relative to said sheet of material, to achieve a predetermined positional relationship between said sheet of material and said stamping device, and wherein:

said cut produces a closed gap in said linking portion;

said regions exhibiting different visual properties form a pattern on said sheet of material; and said predetermined positional relationship is chosen such that said closed gap is selectively positioned relative to said pattern.

12. The method as claimed in claim 2, comprising, before stamping, orienting the stamping device, relative to said sheet of material, to achieve a predetermined positional relationship between said sheet of material and said stamping device, and wherein:

said stamped link element has a designated center;

said cut produces a closed gap in said linking portion;

said regions exhibiting different visual properties are formed from elongated regions adjoined along longitudinal side edges thereof; and said predetermined positional relationship is chosen such that a line extending from said link element designated center through said closed gap lies parallel to the longitudinal edges of said elongated regions.

13. The method as claimed in claim 2, comprising, before stamping, orienting the stamping device, relative to said sheet of material, to achieve a predetermined positional relationship between said sheet of material and said stamping device, and wherein:

said stamped link element has a designated center;

said cut produces a closed gap in said linking portion;

said regions exhibiting different visual properties are formed from elongated regions adjoined along longitudinal side edges thereof; and said predetermined positional relationship is chosen such that a line extending from said link element designated center through said closed gap lies non-parallel to the longitudinal edges of said elongated regions.

14. The method as claimed in claim 2, comprising:

assembling a plurality of said link elements to produce an assembled closed-link chain; and subjecting said assembled closed-link chain to a compression operation to flatten said chain and form pressed regions where said linking portions pass through said enclosed open areas.

15. The method as claimed in claim 14, comprising:

after assembly of a plurality of said link elements into a closed-link chain, selected portions of said chain are subjected to a post-assembly colorizing process.

16. The method as claimed in claim 14, comprising:

after assembly of a plurality of said link elements into a closed-link chain, selected portions of said chain are subjected to a post-assembly texturing process.

17. The method as claimed in claim 14, wherein, after stamping, and prior to assembling said link elements into a length of closed-link chain, selected link elements are subjected to an additional surface texturing process.

18. A jewelry closed-link chain link element of the type that is assembled with other link elements to form a closed-link chain, said link element comprising:

a first major surface;

an opposite second major surface;

an exterior edge;

at least one enclosed open area, extending through said link element between said major surfaces, for receiving a linking portion of an adjacent link element during assembly of a closed-link chain;

said link element made of a material exhibiting a plurality of regions adjacent ones of which exhibit different visual properties the link element comprising segments of at least two of said plurality of regions.

19. The jewelry closed-link chain link element as claimed in claim 18, wherein:

said regions are defined by multiple layers of sheet material; and said link element segments define first and second major surfaces for said link element.

20. The jewelry closed-link chain link element as claimed in claim 19, wherein:

at least one layer of said multiple layers of sheet material comprises multiple portions, adjacent ones of which exhibit different visual properties; and at least one of said first and second major surfaces comprises segments of said multiple portions.

21. The jewelry closed-link chain link element as claimed in claim 18, wherein:

a cut is provided across a portion of said link element, said cut extending from said exterior edge of said link element to one of said at least one enclosed open areas, said cut link element portion defining a linking portion adaptable to pass through an enclosed open area of an adjacent link element during assembly of a closed-link chain.

22. The link element as claimed in claim 21, wherein said link element is provided with variably selectable multiple regions of different visual properties, thereby achieving a predetermined positional relationship between said cut and said regions of different visual properties.

23. The link element as claimed in claim 18, wherein said regions exhibiting different visual properties are elongated regions adjoined along longitudinal side edges thereof.

24. The link element as claimed in claim 18, wherein each of said different visual properties is at least one visual property selected from the group consisting of different colors, different surface textures, different shapes, different sizes, different reflectivities, different gold karat weights, and different materials.

25. The link element as claimed in claim 18, wherein said link element has a second enclosed open area and a dividing member separating said enclosed open areas.

26. The link element as claimed in claim 24, wherein at least one of said regions has a textured surface selected from the group consisting of serrated, scored, knurled, lined, patterned, pressure stamped, impressed, sandblasted, etched, shaped, polished, matted, frosted, and diamond cut.

27. The link element as claimed in claim 24, wherein:

said regions exhibiting different visual properties include regions having different surface textures superimposed on regions of different colors; and said sheet of material includes at least one of said regions having a surface texture formed therein by employing at least one process selected from the group consisting of serrating, scoring, knurling, lining, patterning, pressure stamping, impressing, sandblasting, etching, shaping, polishing, matting, frosting, and diamond cutting.

28. The link element as claimed in claim 24, wherein:

said regions exhibiting different visual properties include regions having different surface textures superimposed on regions of different reflectivities; and said sheet of material includes at least one of said regions having a surface texture formed therein by employing at least one process selected from the group consisting of serrating, scoring, knurling, lining, patterning, pressure stamping, impressing, sandblasting, etching, shaping, polishing, matting, frosting, and diamond cutting.

29. The link element as claimed in claim 24, wherein:

said regions exhibiting different visual properties include regions having different surface textures superimposed on regions of different materials; and said sheet of material includes at least one of said regions having a surface textures formed therein by employing at least one process selected from the group consisting of serrating, scoring, knurling, lining, patterning, pressure stamping, impressing, sandblasting, etching, shaping, polishing, matting, frosting, and diamond cutting.

30. The link element as claimed in claim 21, wherein:

said cut produces a closed gap in said linking portion;

said regions exhibiting different visual properties form a pattern on said link element; and said predetermined positional relationship is chosen such that said closed gap is selectively positioned relative to said pattern.

31. The link element as claimed in claim 30, wherein:

said stamped link element has a designated center;

said regions exhibiting different visual properties are formed from elongated regions adjoined along longitudinal side edges thereof; and said predetermined positional relationship is chosen such that a line extending from said link element designated center through said closed gap lies parallel to the longitudinal edges of said elongated regions.

32. The link element as claimed in claim 30, wherein:

said stamped link element has a designated center;

said regions exhibiting different visual properties are formed from elongated regions adjoined along longitudinal side edges thereof; and said predetermined positional relationship is chosen such that a line extending from said link element designated center through said closed gap lies non-parallel to the longitudinal edges of said elongated regions.

33. The link element of claim 18, wherein the link element has a variable cross section along its extent.

34. The link element of claim 33, wherein the cross section continuously changes along its extent from a first location showing a first cross section configuration to a second location showing a second cross section configuration.

35. The link element of claim 3, wherein the cross section continuously changes along its extent from a first location showing a first cross section configuration to a second location showing a second cross section configuration.

36. A closed-link element of the type that is assembled with other closed-link elements to form a closed-link jewelry chain, said closed-link element comprising:

a first link element portion exhibiting a first visual property, and a second link element portion exhibiting a second, different, visual property;

an enclosed open area extending through said link element; and a linking portion adapted to pass through the enclosed open area of an adjacent link element, wherein said link element portions define first and second major surfaces for said link element, and wherein at Least one of said first and second major surfaces comprises segments, adjacent ones of which exhibit different visual properties.

37. The closed-link element as claimed in claim 36, wherein:

said link element is stamped, with a stamping device in a stamping operation, from a sheet of material having a plurality of regions adjacent ones of which exhibit different visual properties.

38. The closed-link element as claimed in claim 36, wherein each of said different visual properties is at least one visual property selected from the group consisting of different colors, different surface textures, different shapes, different sizes, different reflectivities, different gold karat weights, and different materials.

39. The closed-link element as claimed in claim 37, wherein said closed-link element is provided with variably selectable multiple segments of different visual properties by orienting the stamping device, relative to said sheet of material, in said stamping operation to achieve a predetermined positional relationship between said sheet of material and said stamping device.

40. The closed-link element as claimed in claim 37, wherein said regions exhibiting different visual properties are elongated regions adjoined along longitudinal side edges thereof.

41. The closed-link element as claimed in claim 37, wherein:

said sheet of material from which said closed-link element is stamped comprises an elongated length of material having a prescribed width;

said elongated length of material comprises a plurality of elongated strips, each having a prescribed width less than that of said elongated length of material and exhibiting a visual property different than that of an adjacent elongated strip; and said plurality of elongated strips are aligned lengthwise of said elongated length of material.

42. The closed-link element as claimed in claim 37, wherein:

said sheet of material from which said closed-link element is stamped comprises an elongated length of material having a prescribed width;

said elongated length of material comprises a plurality of elongated strips, each having a prescribed width less than that of said elongated length of material and exhibiting a visual property different than that of an adjacent elongated strip; and said plurality of elongated strips are aligned crosswise of said elongated length of material.

43. The closed-link element as claimed in claim 36, wherein said closed-link element has a second enclosed open area and a dividing member separating said enclosed open areas.

44. The closed-link element as claimed in claim 37, therein at least one of said link portions has a textured surface selected from the group consisting of serrated scored, knurled, lined patterned, pressure stamped, impressed, sandblasted, etched, shaped, polished, matted, frosted, and diamond cut.

45. The closed-link element as claimed in claim 38, wherein:

said portions exhibiting different visual properties include portions having different surface textures superimposed on portions of different colors; and at least one of said portions has a surface texture formed therein by employing at least one process selected from the group consisting of serrating, scoring, knurling, lining, patterning, pressure stamping, impressing, sandblasting, etching, shaping, polishing, matting, frosting, and diamond cutting.

46. The closed-link element as claimed in claim 38, wherein:

said portions exhibiting different visual properties include portions having different surface textures superimposed on portions of different reflectivities; and at least one of said portions has a surface texture formed by employing at least one process selected from the group consisting of serrating, scoring, knurling, lining, patterning, pressure stamping, impressing, sandblasting, etching, shaping, polishing, matting, frosting, and diamond cutting.

47. The closed-link element as claimed in claim 38, wherein:

said portions exhibiting different visual properties include portions having different surface textures superimposed on portions of different materials; and at least one of said portions has a surface texture selected from the group consisting of serrated, scored, knurled, lined, patterned, pressure stamped, impressed, sandblasted, etched shaped, polished, matted, frosted, and diamond cut.

48. The closed-link element as claimed in claim 39, wherein:

said stamped closed-link element has a closed gap in said linking portion;

said regions exhibiting different visual properties form a pattern on said closed-closed-link element; and said predetermined positional relationship is chosen such that said closed gap is selectively positioned relative to said pattern.

49. The link element of claim 36, wherein the link element has a variable cross section along its extent.

50. A closed-link element of the type that is assembled with other closed-link elements to form a closed-link jewelry chain, said closed-link element comprising:

a first link element portion exhibiting a first visual property, and a second link element portion exhibiting a second, different, visual property, said link element portions defining first and second major surfaces for said link element;

an enclosed open area extending through said link element; and a linking portion adapted to pass through the enclosed open area of an adjacent link element, the link element being in combination with, and interconnected with, other similar closed-link chain link elements to form a length of jewelry chain, wherein:

said link elements are coupled together along said length of jewelry chain such that all first major surfaces of all link elements face in the same direction, and all second major surfaces of all link elements face in the opposite direction, whereby said chain is reversible to display, when worn in one orientation of the chain, the visual properties of said first major surfaces, and to display, when worn in another orientation of the chain, the visual properties of said second major surfaces.

51. A closed-link element of the type that is assembled with other closed-link elements to form a closed-link jewelry chain, said closed-link element comprising:

a first link element portion exhibiting a first visual property, and a second link element portion exhibiting a second, different, visual property;

an enclosed open area extending through said link element; and a linking portion adapted to pass through the enclosed open area of an adjacent link element, the link element being in combination with, and interconnected with, other similar closed-link chain link elements to form a length of jewelry chain wherein:

each said link element linking portion is adapted to pass through the enclosed open areas of an adjacent link element and the next downstream link element in both directions along a length of assembled link elements forming said length of jewelry chain, thereby presenting the appearance of intertwining helical strands of rope, whereby each link element has a total of four adjacent and next-adjacent link element linking portions passing through its enclosed open area; and each said helical strand of rope has a unique visual property.

52. A closed-link element of the type that is assembled with other closed-link elements to form a closed-link jewelry chain, said closed-link element comprising:

a first link element portion exhibiting a first visual property, and a second link element portion exhibiting a second, different, visual property;

an enclosed open area extending through said link element; and a linking portion adapted to pass through the enclosed open area of an adjacent link element, wherein:

said first link element portion comprises a relatively thick layer of a first material exhibiting a first visual property; and said second link element portion comprises a relatively thin layer of a second material exhibiting a second visual property.

53. The jewelry link element as claimed in claim 52, wherein:

said first material comprises a plurality of regions, adjacent ones of which exhibit different visual properties.

54. The jewelry link element as claimed in claim 52, wherein:

said second material comprises a plurality of regions, adjacent ones of which exhibit different visual properties.

55. The jewelry link element as claimed in claim 52, wherein:

said first material comprises a plurality of regions, adjacent ones of which exhibit different visual properties; and said second material comprises a plurality of regions, adjacent ones of which exhibit different visual properties.

56. The jewelry link element as claimed in claim 52, wherein:

said first and second layers define first and second major surfaces, respectively, of said link element.

57. A method of manufacturing a link element of the type that are assembled to form a closed-link chain, said method comprising:

providing a sheet of material having a plurality of regions, adjacent ones of which exhibit different visual properties;

stamping, with a stamping device, an elongated strip of said material, said strip having a prescribed length, width, and thickness; and forming said strip into a chain link element having a generally closed-link configuration, a first major surface, an opposite second major surface, an interior edge, an exterior edge, a width, and a thickness, the link element so produced comprising portions of said sheet of material that exhibit at least two of said visual properties.

58. The method as claimed in claim 57, wherein:

said strip width defines said first and second major surfaces;

said first and second major surfaces have different visual properties; and said strip thickness defines said interior and exterior edges.

59. The method as claimed in claim 57, wherein:

said sheet of material comprises a plurality of layers of different material, each layer exhibiting a different visual property than a next adjacent layer.

60. The method as claimed in claim 57, wherein each of said different visual properties is at least one visual property selected from the group consisting of different colors, different surface textures, different shapes, different sizes, different reflectivities, different gold karat weights, and different materials.

61. The method as claimed in claim 60, wherein providing a sheet of material includes forming at least one of said regions of different surface texture by employing at least one process selected from the group consisting of serrating, scoring, knurling, lining, patterning, pressure stamping, impressing, sandblasting, etching, shaping, polishing, matting, frosting, and diamond cutting.

62. The method as claimed in claim 60, wherein:

said regions exhibiting different visual properties include regions having different surface textures superimposed on regions of different colors; and providing a sheet of material includes forming at least one of said regions of different surface texture by employing at least one process selected from the group consisting of serrating, scoring, knurling, lining, patterning, pressure stamping, impressing, sandblasting, etching, shaping, polishing, matting, frosting, and diamond cutting.

63. A closed-link chain link element manufactured by the method as claimed in claim 57.

64. A method of manufacturing a closed-link element of the type that is assembled with other link elements to form a closed-link chain, each of said link elements being generally O-shaped in configuration and define a closed gap between facing ends thereof, each of said link elements having a first major surface, an opposite second major surface, an interior edge, and an exterior edge, said method comprising:

providing a plurality of relatively thin wire strands;

bonding said plurality of wire strands together, each exhibiting a different visual property along their lengths to form a relatively thicker compound wire;

cutting predetermined lengths of said compound wire to form elongated strips of bendable material, each said strip having a left end, a right end, and a plurality of regions exhibiting different visual properties; and bending said strip into a generally O-shaped configuration until said left and right ends face one another defining a closed gap between said left and right ends.

65. The method as claimed in claim 64, wherein each of said different visual properties is at least one visual property selected from the group consisting of different colors, different surface textures, different shapes, different sizes, different reflectivities, different gold karat weights, and different materials.

66. The method as claimed in claim 65, wherein providing a sheet of material includes forming at least one of said regions of different surface texture by employing at least one process selected from the group consisting of serrating, scoring, knurling, lining, patterning, pressure stamping, impressing, sandblasting, etching, shaping, polishing, matting, frosting, and diamond cutting.

67. A closed-link element of the type that is assembled with other link elements to form a closed-link chain, each of said link elements being generally O-shaped in configuration and define a closed gap between facing ends thereof, each of said link elements having a first major surface, an opposite second major surface, an interior edge, and an exterior edge, said closed-link element comprising a plurality of relatively thin wire strands bonded together, each exhibiting a different visual property along their lengths to form a relatively thicker compound wire, wherein:

a predetermined length of said compound wire is in the form of an elongated strip of material, having a left end, a right end, and a plurality of regions, between said left and right ends, exhibiting different visual properties; and said elongated strip of material is shaped to have a generally O-shaped configuration with said left and right ends facing adjacent one another defining a closed gap between said left and right ends.

* * * * *